US010205262B2

(12) United States Patent
Richter et al.

(10) Patent No.: US 10,205,262 B2
(45) Date of Patent: Feb. 12, 2019

(54) MULTI-CONTACT PLUG ON RAIL

(71) Applicant: Hilti Aktiengesellschaft, Schaan (LI)

(72) Inventors: Rene Richter, Augsburg (DE); Thomas Thanner, Munich (DE); Juliane Froeschke, Senftenberg (DE); Johannes Stempfhuber, Utting am Ammersee (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 15/544,139

(22) PCT Filed: Mar. 4, 2016

(86) PCT No.: PCT/EP2016/054644
§ 371 (c)(1),
(2) Date: Jul. 17, 2017

(87) PCT Pub. No.: WO2016/142286
PCT Pub. Date: Sep. 15, 2016

(65) Prior Publication Data

US 2018/0006392 A1 Jan. 4, 2018

(30) Foreign Application Priority Data

Mar. 6, 2015 (EP) ..... 15157962

(51) Int. Cl.
*H01R 4/18* (2006.01)
*H01R 13/11* (2006.01)
*H01R 13/187* (2006.01)

(52) U.S. Cl.
CPC ..... *H01R 13/187* (2013.01); *H01R 13/112* (2013.01); *H01R 4/185* (2013.01)

(58) Field of Classification Search
CPC ... H01R 13/112–13/115; H01R 13/187; H01R 2201/26; H01R 4/4881
(Continued)

(56) References Cited

U.S. PATENT DOCUMENTS 3,183,471 A * 5/1965 Burkert ..... H01R 13/115 403/345
4,083,622 A * 4/1978 Neidecker ..... H01R 13/187 439/843
(Continued)

FOREIGN PATENT DOCUMENTS

| | | |
|---|---|---|
| DE | 3014118 | 2/1981 |
| EP | 2451016 | 5/2012 |
| JP | S518453 | 3/1976 |

OTHER PUBLICATIONS

International Search Report of PCT/EP2016/054644, dated May 2, 2016.

*Primary Examiner* — Edwin A. Leon
*Assistant Examiner* — Oscar Jimenez
(74) *Attorney, Agent, or Firm* — Davidson, Davidson & Kappel, LLC

(57) ABSTRACT

A connecting device for detachably connecting electrical connections, for example between a rechargeable battery and an electrical power tool or a rechargeable battery and a charging device. The connecting device includes a carrier unit and at least one receptacle connectable to the carrier unit. A receptacle as part of and for connection to a connecting device. A carrier unit as part of a connecting device and for accommodating at least one receptacle.

9 Claims, 50 Drawing Sheets

B

(58) Field of Classification Search
USPC ..... 439/843–847, 857, 891, 668, 669
See application file for complete search history.

(56) References Cited

U.S. PATENT DOCUMENTS

| | | | | |
|---|---|---|---|---|
| 4,456,325 | A | 6/1984 | Benz | |
| 5,588,884 | A * | 12/1996 | Rudoy | H01R 13/187 439/787 |
| 6,312,276 | B1 * | 11/2001 | Lin | H01R 13/112 439/342 |
| 6,350,149 | B1 * | 2/2002 | Nakane | H01M 2/1022 439/500 |
| 7,837,521 | B2 | 11/2010 | Kato et al. | |
| 8,419,486 | B2 | 4/2013 | Tyler | |
| 8,690,609 | B2 * | 4/2014 | Poon | H01R 13/187 439/668 |
| 9,502,801 | B2 * | 11/2016 | Ogura | H01R 13/04 |
| 9,577,228 | B2 * | 2/2017 | Naito | H01M 2/1055 |
| 9,601,729 | B2 * | 3/2017 | Naito | H01M 2/1055 |
| 2003/0060090 | A1 * | 3/2003 | Allgood | H01R 11/289 439/845 |
| 2006/0014442 | A1 * | 1/2006 | Allgood | H01R 11/289 439/843 |
| 2013/0330981 | A1 * | 12/2013 | Blakborn | H01R 13/113 439/788 |
| 2014/0141655 | A1 * | 5/2014 | Do | H01R 13/187 439/669 |
| 2014/0242836 | A1 * | 8/2014 | Brand | H01R 9/2458 439/569 |

* cited by examiner

MULTI-CONTACT PLUG ON RAIL

The present invention relates to a connecting device for detachably connecting electrical connections, for example between a rechargeable battery and an electrical power tool or a rechargeable battery and a charging device. The present invention furthermore relates to a receptacle as part of and for connection to the connecting device, as well as a carrier unit as part of the connecting device.

BACKGROUND

Electrical power tools and rechargeable batteries may be connected to each other with the aid of an electrical connecting device. Frequently it is a detachable connection. The power tool includes electrical contacts for this purpose (also called plugs), which are inserted into correspondingly designed receptacles on the rechargeable battery when the rechargeable battery is connected to the power tool. However, it is also possible for the power tool to include the receptacles and the rechargeable battery to include the electrical contacts.

Moreover, charging devices having rechargeable batteries are also connected to each other with the aid of an electrical connecting device. The charging device includes electrical contacts, which are inserted into correspondingly designed receptacles on the rechargeable battery when the rechargeable battery is connected to the power tool. However, it is also possible for the charging device to include the receptacles and the rechargeable battery to include the electrical contacts.

Due to the ever greater capacities of rechargeable batteries and the associated increase in the available current able to flow between the rechargeable battery and the power tool, conventional electrical connecting devices, as well as their contacts and receptacles, are reaching their physical limits. Damage to the connecting devices as well as their contacts and receptacles may thus occur. This problem is frequently solved by correspondingly increasing the dimensions of the contacts and receptacles. Alternatively, the current made available by the high capacity rechargeable battery is restricted to prevent possible damage from occurring in the first place. These existing approaches have the disadvantage that they are too big, too expensive and/or too complex to manufacture. By restricting the current, in turn, the full capacity of the power tool or the charging device is not made available to the user.

Another problem with conventional connecting devices is that they are ordinarily not able to be adapted modularly/flexibly to the corresponding capacity or maximum current of the rechargeable battery. Both the manufacture and the provision of a wide range of connecting devices, adapted to the particular capacity or maximum current of the particular rechargeable battery to be used, involve high costs as well as a great deal of management effort.

SUMMARY OF THE INVENTION

It is an object of the present invention to provide a connecting device for detachably connecting electrical connections, for example between a rechargeable battery and an electrical power tool or a rechargeable battery and a charging device, with the aid of which the aforementioned problems may be solved and, in particular, an improved, i.e. modularly usable, connecting device may be provided, which is more flexible to manufacture.

For this purpose, a connecting device is provided for detachably connecting electrical connections, for example between a rechargeable battery and an electrical power tool or a rechargeable battery and a charging device.

According to the present invention, the connecting device includes a carrier unit and at least one receptacle connectable to the carrier unit.

According to one advantageous specific embodiment of the present invention, it may be provided that at least one second receptacle, connectable to the carrier unit, is provided, the at least first and second receptacles being positioned consecutively in series along the carrier unit in such a way that a contact element is connected to the at least first and second receptacles when the contact element is connected to the connecting device. The contact surface between the connecting device and the contact element may be enlarged hereby, so that a higher current may flow between the connecting device and the contact element.

To provide a preferably optimum cross-sectional surface for accommodating the receptacles, it may be possible, according to another advantageous specific embodiment, for the carrier unit to essentially include a U profile having at least two holding elements for positioning and holding the receptacle on the carrier unit.

According to another advantageous specific embodiment of the present invention, it is possible that the receptacle contains a first end, a second end, a base element, a first wall element, a second wall element and a spring unit, which includes a first spring element and a second spring element for accommodating and holding a contact element, the first spring element being connected to the first wall element, and the second spring element being connected to the second wall element. A practicable and efficient answer for a detachable connection of the receptacles to a contact element is created hereby.

According to another advantageous specific embodiment of the present invention, it may be provided that the first spring element and the second spring element extend from the first end between the first and second wall element to the second end in one direction.

Likewise, according to another advantageous specific embodiment of the present invention, it may be possible that the first spring element and the second spring element extend from the second end in one direction.

To orient a first receptacle and a second receptacle with respect to each other on the carrier unit, it may be possible, according to another advantageous specific embodiment, that the base element of the receptacle includes a convexity and an indentation, the convexity being situated opposite the indentation, and the design of the convexity corresponding to the design of the indentation, so that the convexity of a first receptacle is insertable into the indentation of a second receptacle.

A receptacle is furthermore provided as part of and for connection with the connecting device.

Moreover, a carrier unit is provided as part of the connecting device and to accommodate at least one receptacle.

Further advantages result from the following description of the figures. The figures illustrate different exemplary embodiments of the present invention. The figures, the description and the claims contain numerous features in combination. Those skilled in the art will advantageously also consider the features individually and combine them to form other reasonable combinations.

BRIEF DESCRIPTION OF THE DRAWINGS

In the figures, identical and equivalent components are provided with identical reference numerals.

DETAILED DESCRIPTION

Connecting device 1 according to the present invention for detachably connecting electrical connections, for example between a rechargeable battery and an electrical power tool or a rechargeable battery and a charging device, essentially includes a carrier unit 2 and one or multiple receptacles 3. Connecting device 1 and, in particular, receptacles 3, are primarily used to accommodate a contact element and thus establish an electrical connection between connecting device 1 and receptacles 3. The contact element may also be referred to as a tab, blade or blade element.

In FIGS. 1 through 5, carrier unit 2 of connecting device 1 is represented according to a first specific embodiment.

Figure 1:
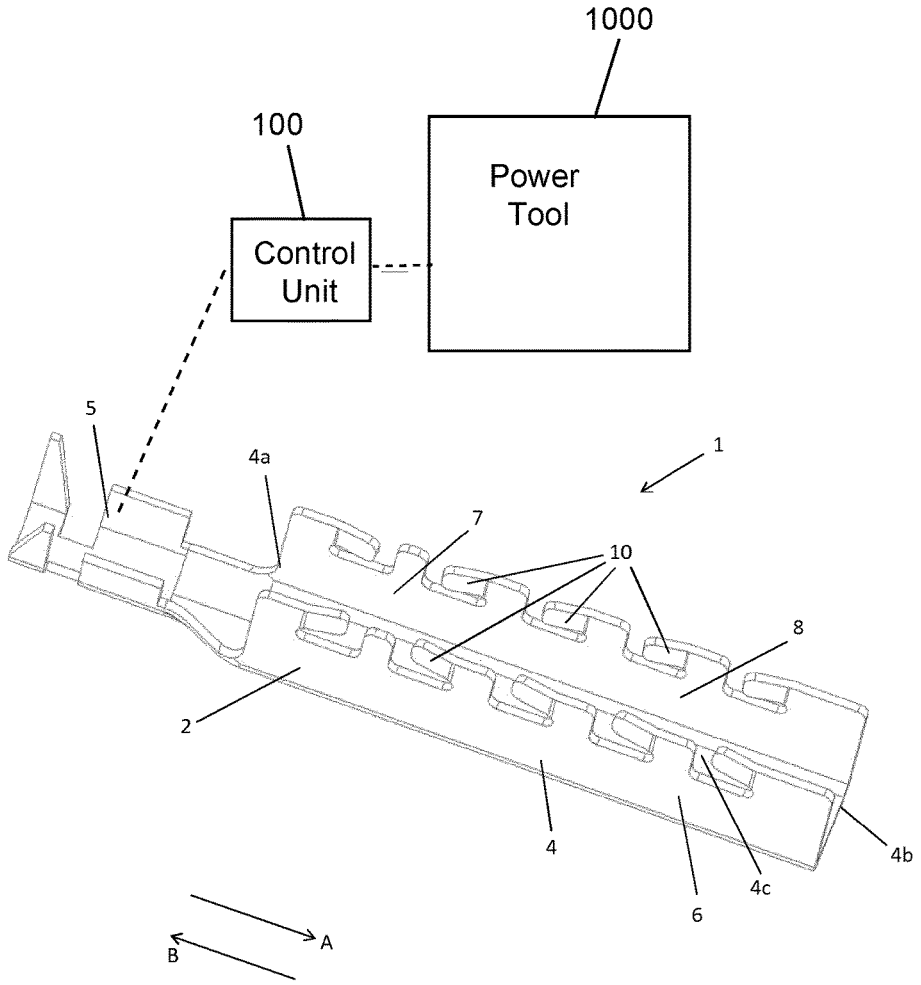
FIG. 1 shows a perspective view of a carrier unit according to a first specific embodiment.

FIG. 1 shows a perspective view of carrier unit 2, which essentially includes a base body 4 and a connecting element 5.

Connecting element 5 is used to connect connecting device 1 to the control unit or electronics of a power tool, charging unit or rechargeable battery, depending on whether connecting device 1 is contained in a power tool, charging unit or rechargeable battery. Connecting element 5 may be connected to the control unit or electronics with the aid of a cable or a litz wire, which is crimped, soldered or welded to connecting element 5. Control unit 100 of power tool 1000 is shown schematically as connected to connecting element 5.

Figure 2:
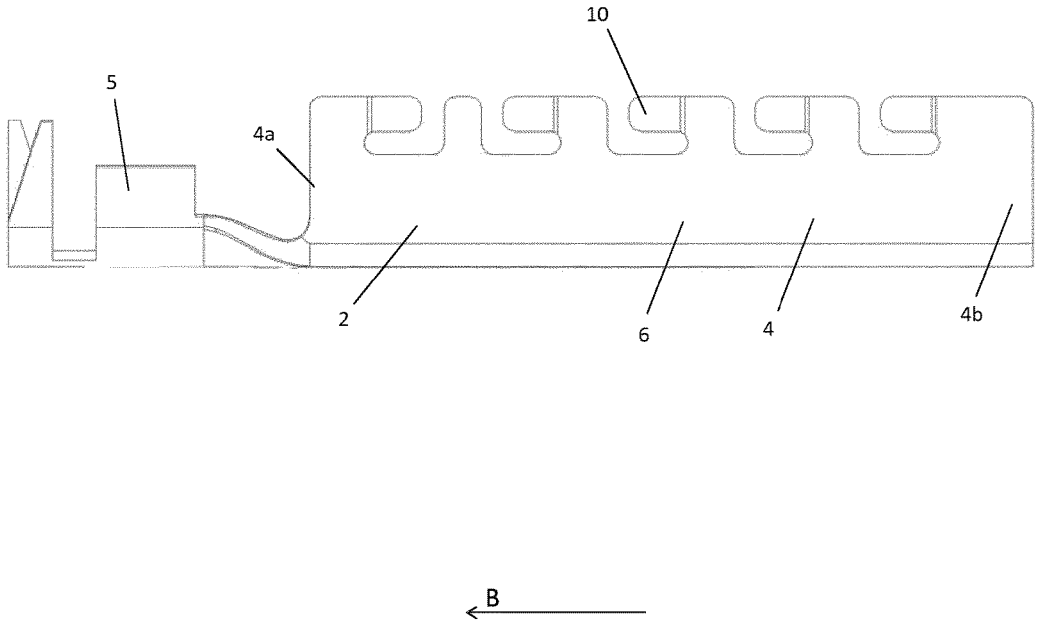
FIG. 2 shows a side view of the carrier unit according to the first specific embodiment.
Figure 3:
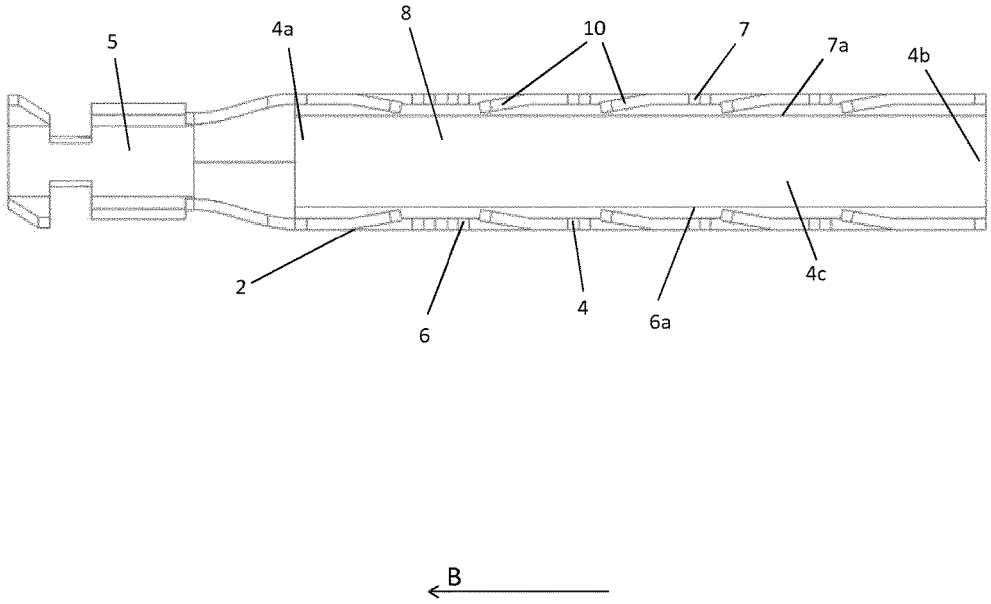
FIG. 3 shows a top view of the carrier unit according to the first specific embodiment.
Figure 4:
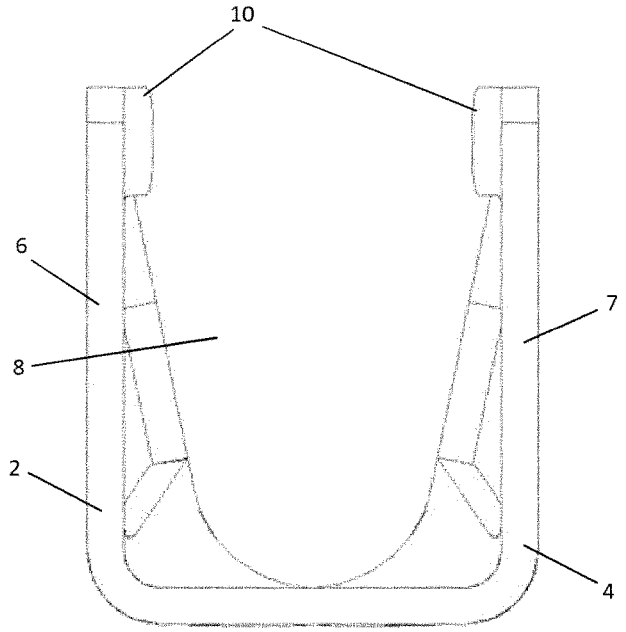
FIG. 4 shows a front view of the carrier unit according to the first specific embodiment.
Figure 5:
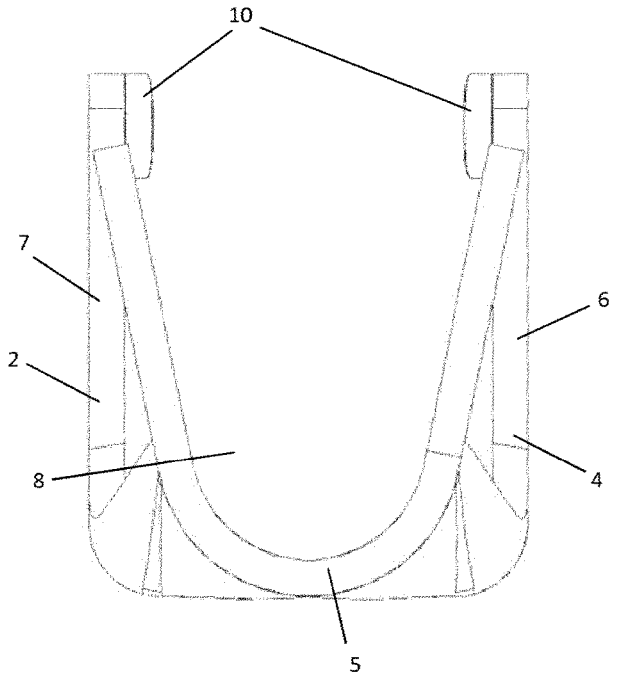
FIG. 5 shows a rear view of the carrier unit according to the first specific embodiment.
Figure 6:
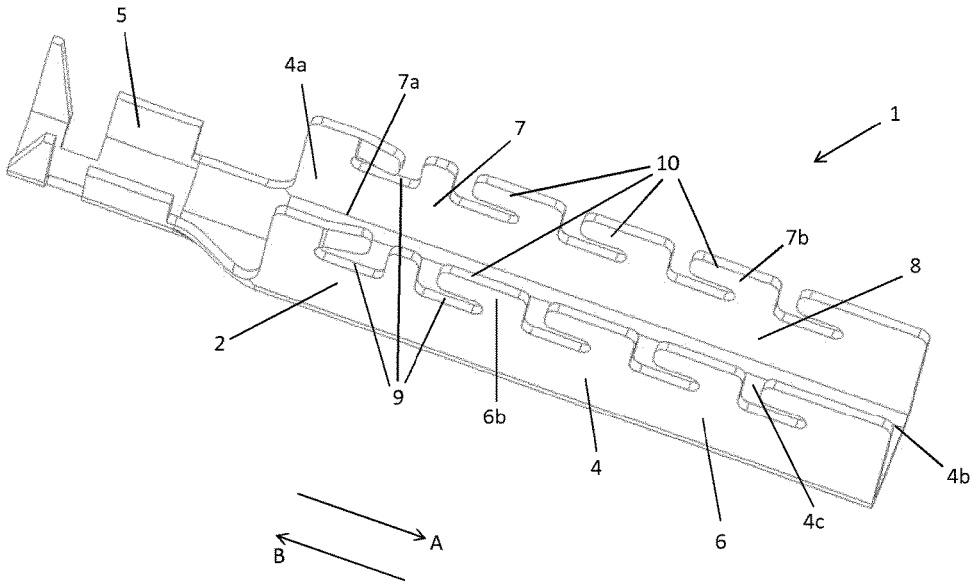
FIG. 6 shows a perspective view of a carrier unit according to a second specific embodiment.
Figure 7:
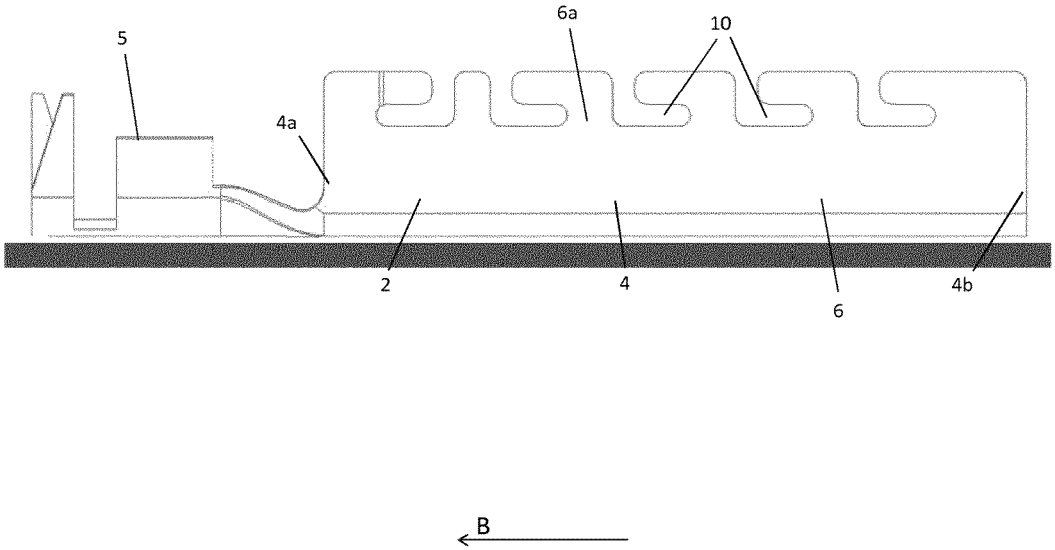
FIG. 7 shows a side view of the carrier unit according to a second specific embodiment.
Figure 8:
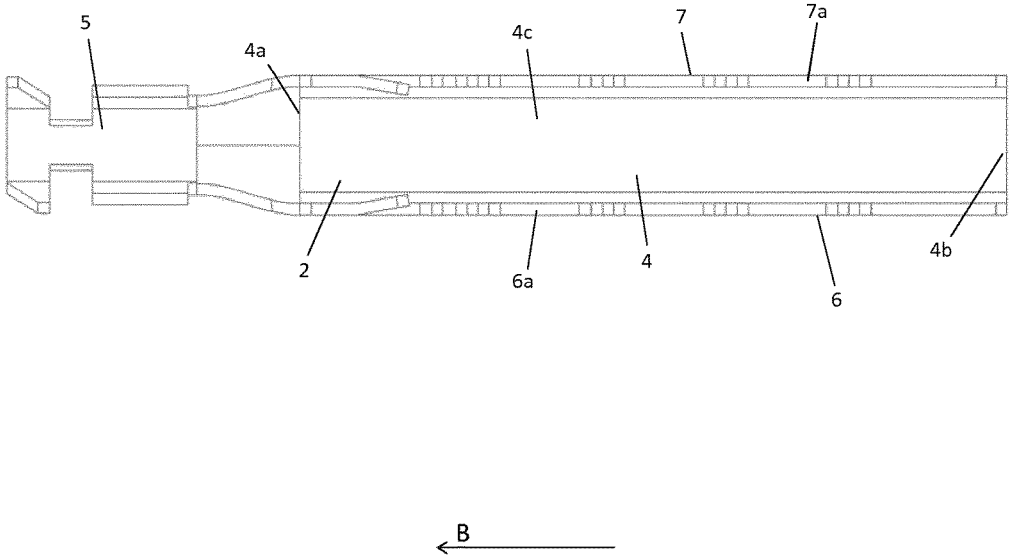
FIG. 8 shows a top view of the carrier unit according to the second specific embodiment.
Figure 9:
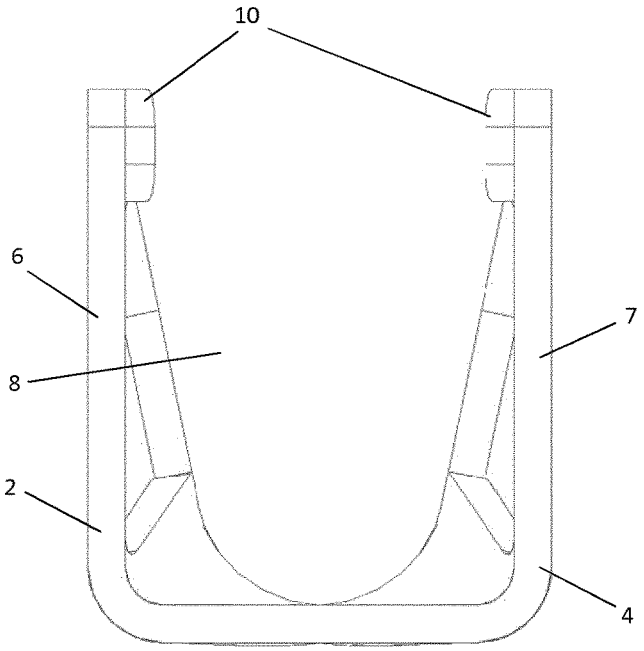
FIG. 9 shows a front view of the carrier unit according to the second specific embodiment.
Figure 10:
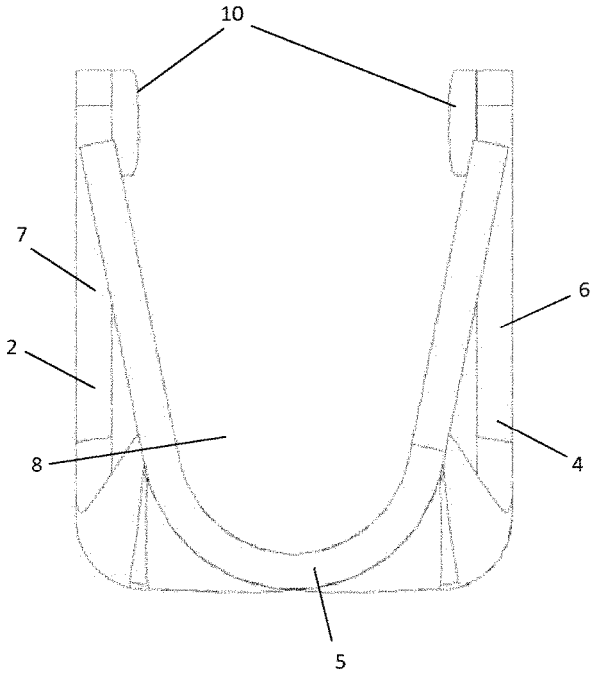
FIG. 10 shows a rear view of the carrier unit according to the second specific embodiment.

Base body 4 of carrier unit 2 extends in an elongated shape and includes a first end 4*a*, a second end 4*b*, a base element 4*c*, a first side element 6 and a second side element 7. Base body 4 is made from a conductive material. Both first side element 6 and second side element 7 each include a first side edge 6*a*, 7*a* and a second side edge 6*b*, 7*b*. The two side elements 6, 7 are each connected to base element 4*c* by their first side edges 6*a*, 7*a* in such a way that base body 4 essentially forms the shape of a groove having a cavity 8. Base body 4 has a U-shaped cross section. As is described in greater detail later on, cavity 8 is used to accommodate receptacles 3. Base body 4 extends along direction A and B. First and second side elements 6, 7 have a number of recesses 9 on second side edge 6*b*, 7*b*. As illustrated in FIGS. 1 through 3, five recesses 9 are provided according to one preferred specific embodiment. Recesses 9 essentially run in parallel to the longitudinal extension of side elements 6, 7 and carrier unit 2. Due to recesses 9, a number of holding elements 10 are present on second side edge 6*b* of first side element 6. According to the preferred specific embodiment, five holding elements 10 are positioned on first side edge 6*a* of first side element 6, and five holding elements 10 are positioned on second side edge 6*b* of first side element 6. According to the first specific embodiment of connecting device 1, holding elements 10 of first and second side elements 6, 7 are bent toward each other. In other words, holding elements 10 are each offset in the direction of cavity 8 of carrier unit 2. As described in greater detail below, holding elements 10 are used to position and hold receptacles 3 on carrier unit 2.

It should be noted that holding element 10 closest to first end 4*a* of base body 4 extends in direction A. Remaining holding elements 10 extend in direction B.

In FIGS. 6 through 10, carrier unit 2 of connecting device 1 is represented according to a second specific embodiment. Connecting device 1 according to the second specific embodiment is essentially identical to connecting device 1 according to the first specific embodiment. In contrast to the first specific embodiment, holding elements 10 of first and second side elements 6, 7 according to the second specific embodiment are not bent toward or offset with respect to each other. In other words, holding elements 10 of first and second side elements 6, 7 extend straight to side elements 6, 7 in direction B or, in the case of holding element 10 closest to first end 4*a* of base body 4, in direction A. It should be noted that only opposite holding elements 10 closest to first end 4*a* of base body 4 are bent toward or offset with respect to each other (cf. FIG. 6 or 8).

Figure 11:
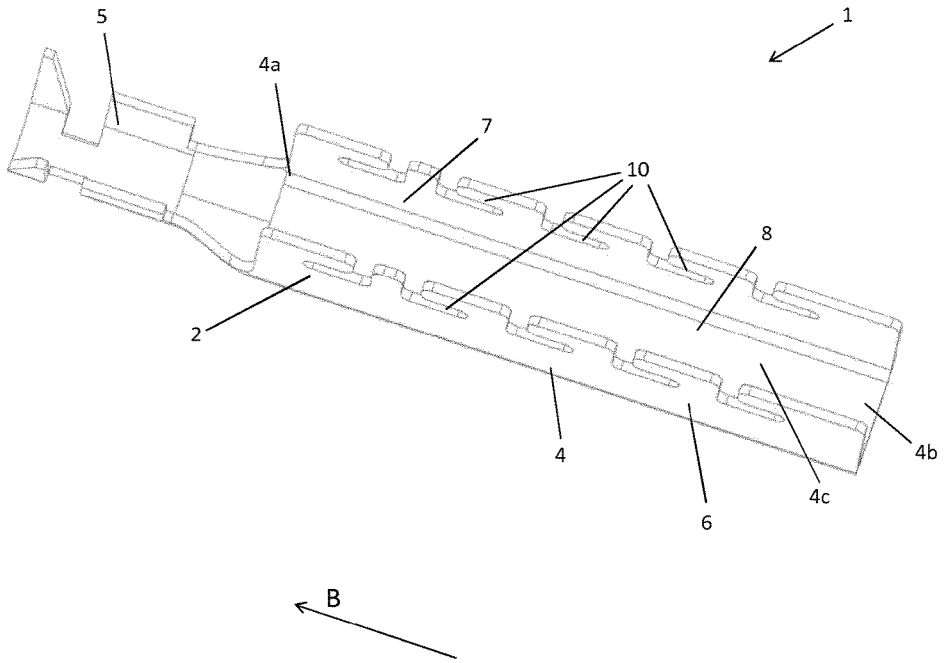
FIG. 11 shows a perspective view of a carrier unit according to a third specific embodiment.
Figure 12:
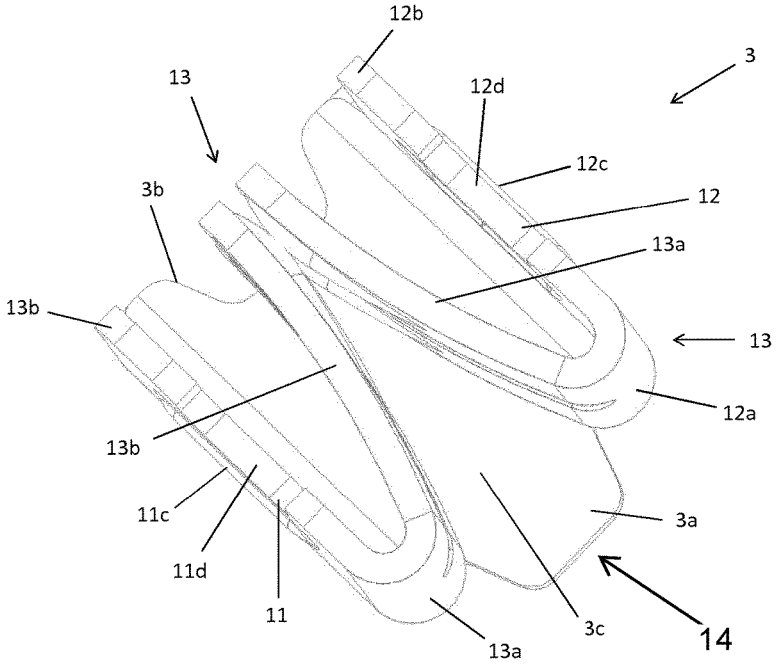
FIG. 12 shows a perspective top view of a receptacle according to a first specific embodiment.

According to another specific embodiment of carrier unit 2, it is possible to design all holding elements 10 to be straight (cf. FIG. 11). This additional specific embodiment thus essentially corresponds to carrier unit 2 of connecting device 1 according to the second specific embodiment, but with the difference that opposite holding elements 10 closest to first end 4*a* of base body 4 are also not bent or offset but extend straight in direction B.

Figure 25:
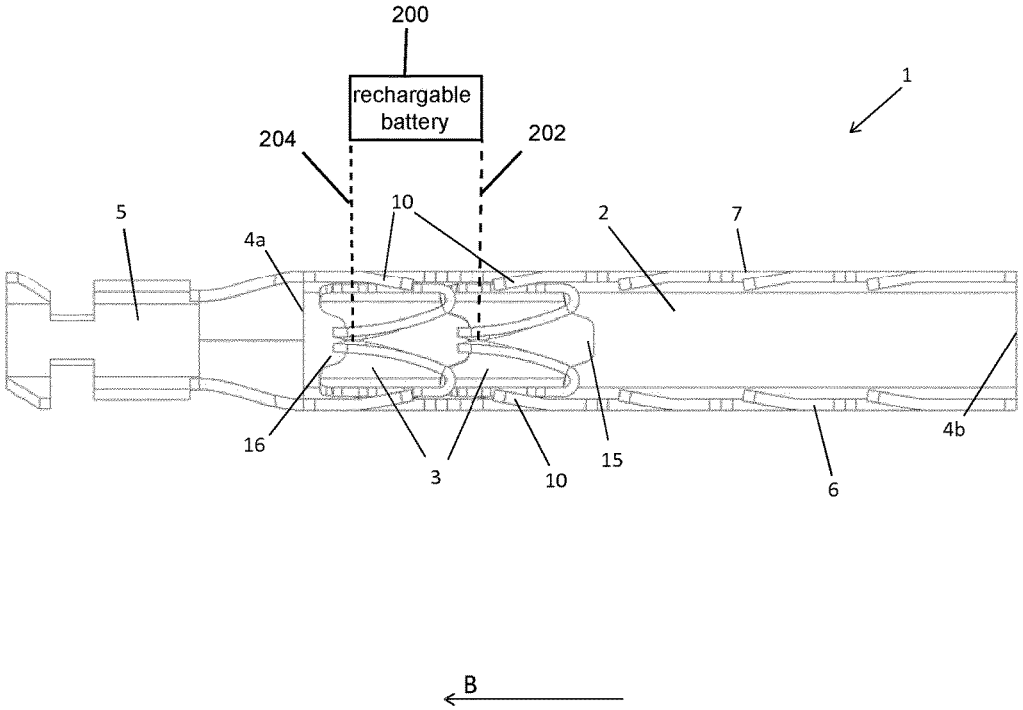
FIG. 25 shows a top view of the carrier unit according to the first specific embodiment, including two receptacles according to the first specific embodiment.

A receptacle 3 according to a first specific embodiment is represented in FIGS. 12 through 17. Receptacle 3 according to the first specific embodiment essentially includes a first end 3*a*, a second end 3*b*, a base element 3*c*, a first wall element 11, a second wall element 12 and a spring unit 13. First wall element 11 includes a front end 11*a*, a rear end 11*b*, an elevation 11*c* and a recess 11*d*. Second wall element 12 also includes a front end 12*a*, a rear end 12*b*, an elevation 12*c* and a recess 12*d*. Spring unit 13, in turn, includes a first spring element 13*a* and a second spring element 13*b* for accommodating and holding an elongated contact element. The contact element is illustrated in FIG. 25. First wall element 11 and second wall element 12 are connected to base element 3*c* and extend essentially orthogonally to base element 3*c*. It should be noted that first wall element 11 and second wall element 12 may form a certain overextension. In other words, the two wall elements 11, 12 are not necessarily situated at a right angle)(90° to base element 3*c*. First wall element 11 extends at an obtuse angle (between 91° and 179° and preferably at) 95° to base element 3*c* in direction C (cf. FIG. 14). Second wall element 12 extends at an obtuse angle (between 91° and 179° and preferably at) 95° to base element 3*c* in direction C' (cf. FIG. 14). Overextended wall elements 11, 12 generate a certain tension or apply a certain pressure to particular side elements 6, 7 of carrier unit 2 when receptacles 3 are situated in carrier unit 2. Due to this tension or pressure of wall elements 11, 12, receptacles 3 are clamped in carrier unit 2 and are held to prevent them from too easily falling out of carrier unit 2.

First elevation 11*c* is positioned externally on wall element 11, i.e. in direction C, and second elevation 12*c* is also positioned externally on second wall element 12, i.e. in direction C'. The two elevations 11*c*, 12*c* act as contact surfaces for receptacle 3 with carrier unit 2. Due to the fact that wall elements 11, 12 have a certain pretension, elevations 11*c*, 12*c* of receptacles 3 are always connected to carrier unit 2 for closing a circuit or for transmitting an electric current from the contact element to carrier unit 2 via receptacle 3.

Recesses 11*d*, 12*d* on particular wall elements 11, 12 have an essentially rectangular design and are used to accommodate holding elements 10 so that receptacles 3 are positioned and held in carrier unit 2 by holding elements 10.

First and second wall elements 11, 12 as well as base element 3*c* form a cavity 14 for accommodating the elongated contact element.

Figure 13:
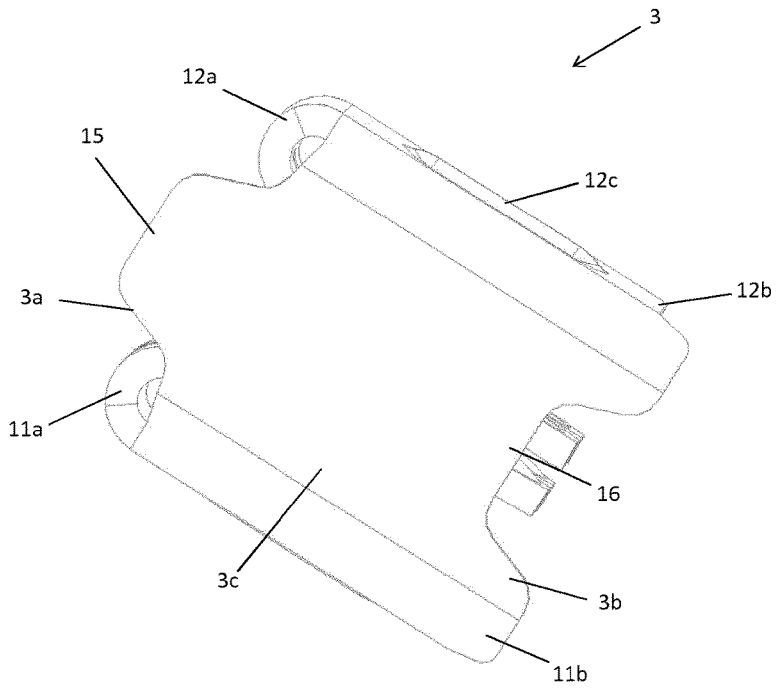
FIG. 13 shows a perspective bottom view of the receptacle according to the first specific embodiment.
Figure 14:
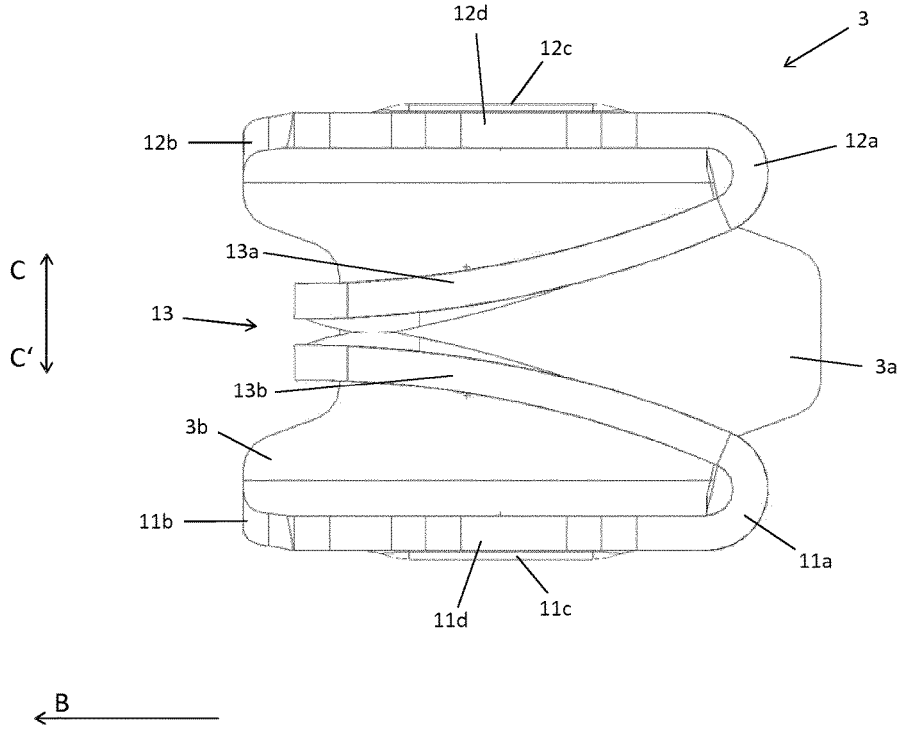
FIG. 14 shows a top view of the receptacle according to the first specific embodiment.
Figure 15:
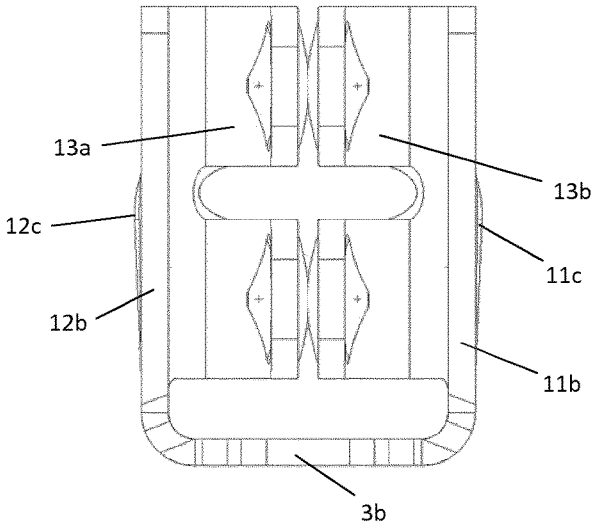
FIG. 15 shows a rear view of the receptacle according to the first specific embodiment.
Figure 16:
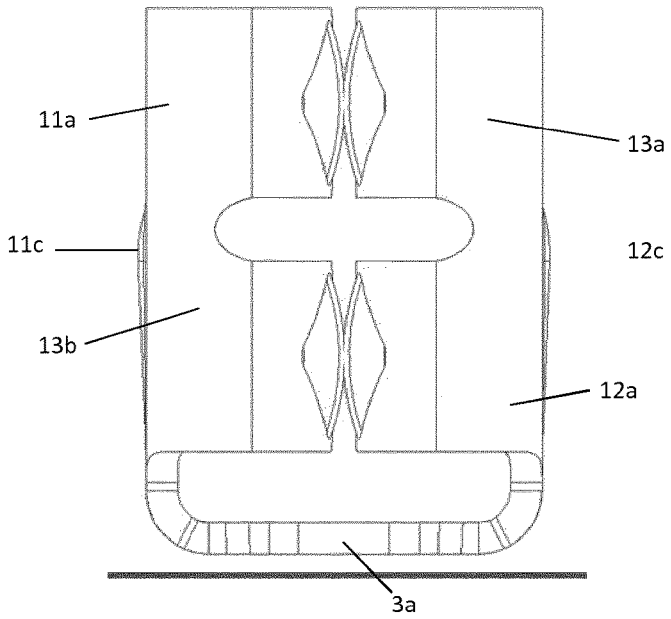
FIG. 16 shows a front view of the receptacle according to the first specific embodiment.
Figure 17:
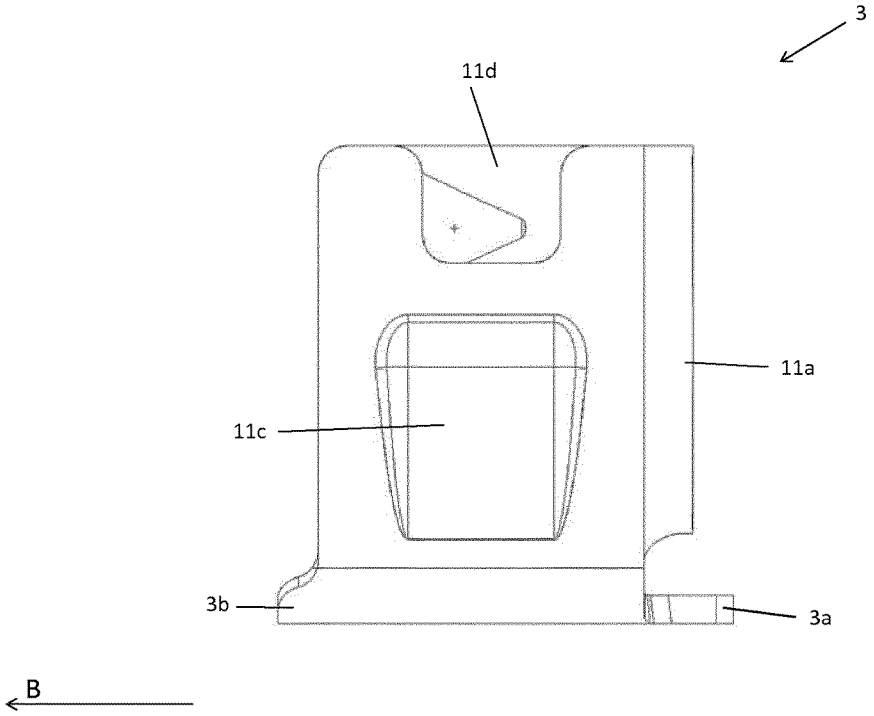
FIG. 17 shows a side view of the receptacle according to the first specific embodiment.
Figure 18:
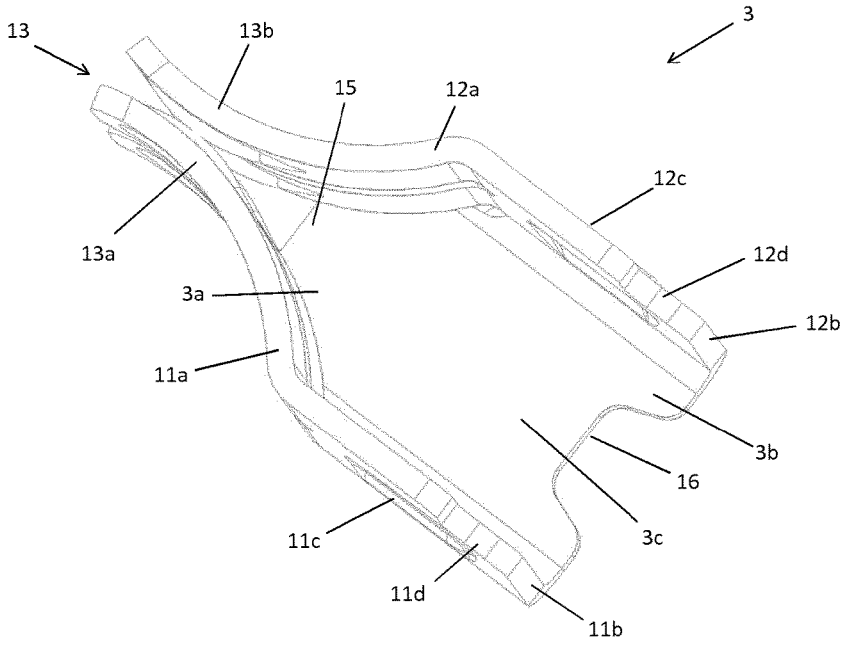
FIG. 18 shows a perspective top view of a receptacle according to a second specific embodiment.
Figure 19:
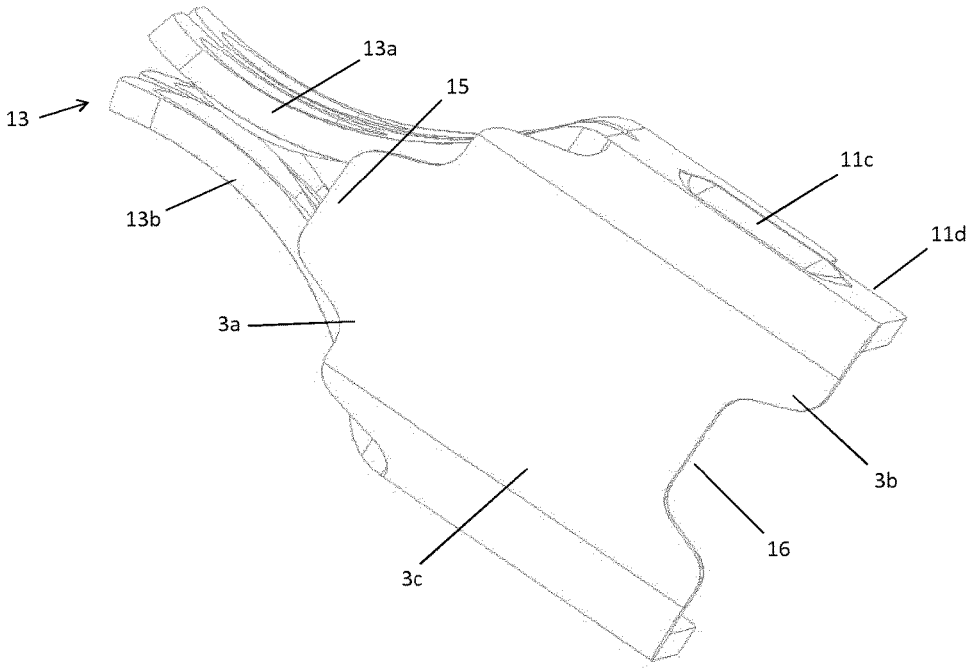
FIG. 19 shows a perspective bottom view of the receptacle according to the second specific embodiment.
Figure 20:
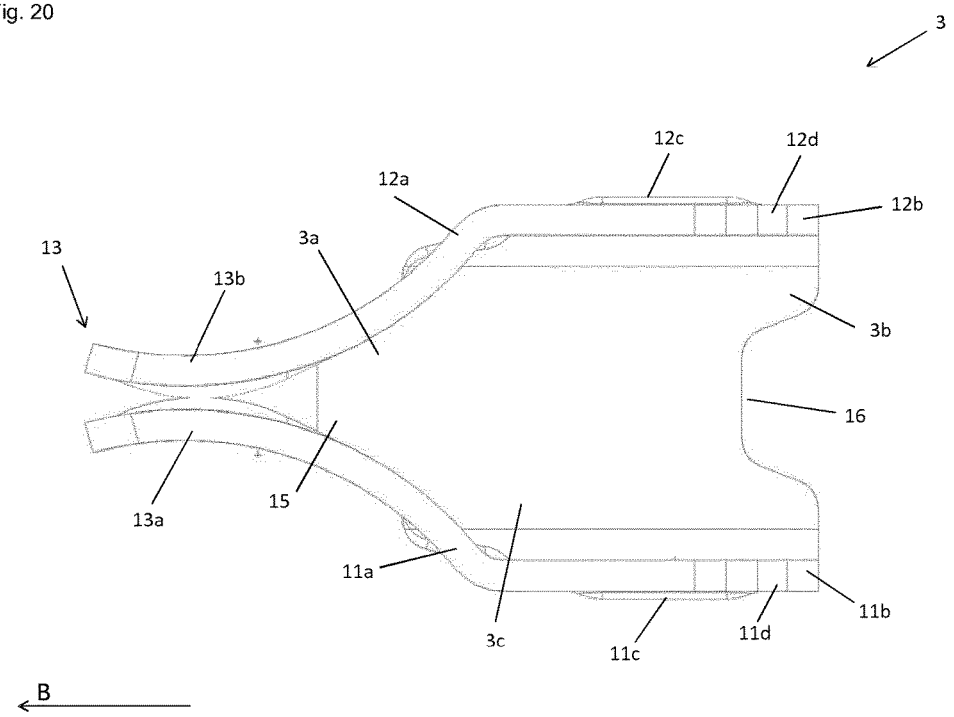
FIG. 20 shows a top view of the receptacle according to the second specific embodiment.
Figure 21:
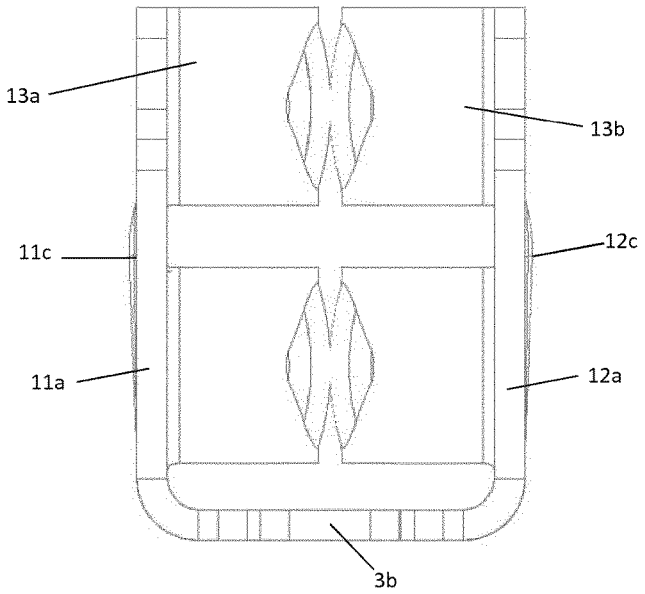
FIG. 21 shows a rear view of the receptacle according to the second specific embodiment.
Figure 22:
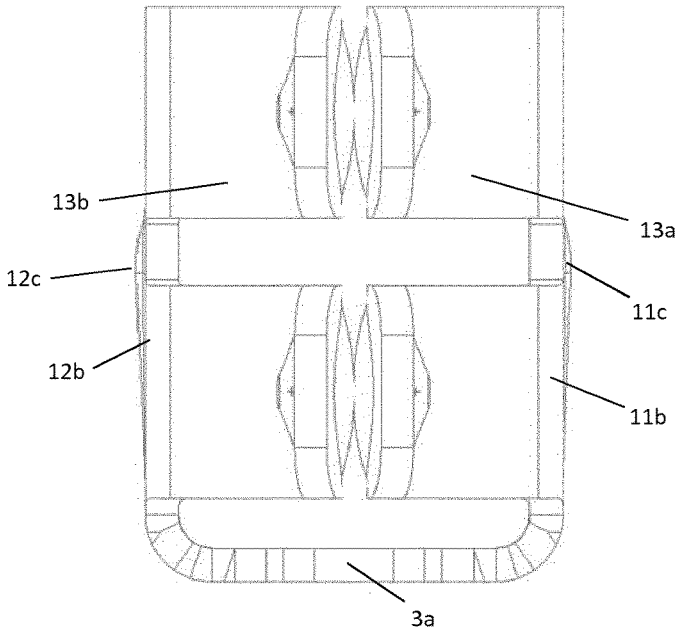
FIG. 22 shows a front view of the receptacle according to the second specific embodiment.
Figure 23:
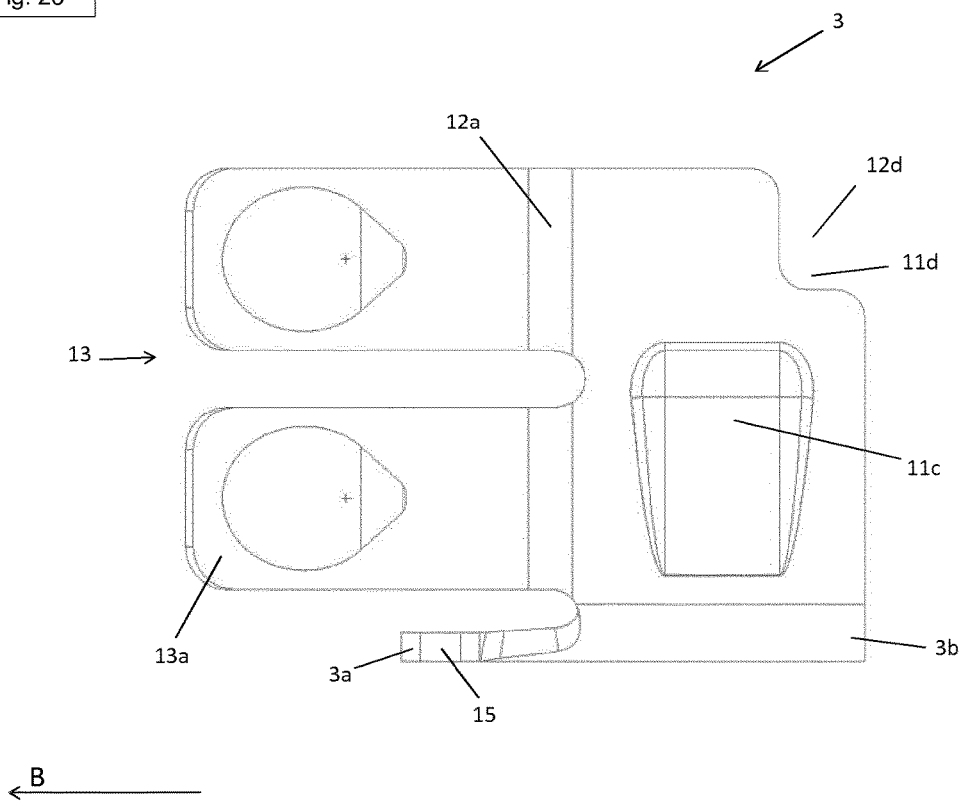
FIG. 23 shows a side view of the receptacle according to the second specific embodiment.

As is apparent, in particular, in FIG. 13, base element 3*c* includes a convexity 15 on a first end and an indentation 16 on a second end. The shape of convexity 15 corresponds to the shape of indentation 16. Convexity 15 and indentation 16 are used to connect and position receptacles 3 with respect to each other on carrier unit 2. For this purpose, convexity 15 of a first receptacle 3 engages with indentation 16 of a second receptacle 3 (cf. FIGS. 25 and 26).

First spring element 13*a* extends in bent form from rear end 11*b* of first wall element 11 in the direction of front end 11*a* of first wall element 11. Second spring element 13*b* extends in bent form from rear end 12*b* of second wall element 12 in the direction of front end 12*a* of second wall element 12. First and second spring elements 13*a*, 13*b* may be reversibly moved from a first position into a second position. In FIGS. 11 through 14, the two spring elements 13*a*, 13*b* are illustrated in the first position, the two spring elements 13*a*, 13*b* touching each other at the free ends with the aid of their spring force. The two spring elements 13*a*, 13*b* are situated in the second position when the two spring elements 13*a*, 13*b* are moved away from each other against their spring force and in the direction of particular wall elements 11, 12. Spring elements 13*a*, 13*b* are not illustrated in the second position in the figures. Spring elements 13*a*, 13*b* may be moved from the first position into the second position to accommodate and hold the contact element with the aid of the spring force when the contact element is pushed between spring elements 13*a*, 13*b*.

A receptacle 3 according to a second specific embodiment is represented in FIGS. 18 through 23. Receptacle 3 according to the second specific embodiment is essentially identical to receptacle 3 according to the first specific embodiment. In contrast to the first specific embodiment, first spring element 13*a* is situated on front end 11*a* of first wall element 11 and extends in bent form in direction B. Second spring element 13*b* is situated on front end 12*a* of second wall element 12 and extends in bent form in direction B. Like spring elements 13*a*, 13*b* of the first specific embodiment, spring elements 13*a*, 13*b* of the second specific embodiment may also be reversibly moved from a first position into a second position to accommodate and hold a contact element.

As mentioned above, cavity 8 of base body 4 of carrier unit 2 is used to accommodate and hold one or multiple receptacle(s) 3. The contact element to be connected to connecting device 1 is always connected to all receptacles 3 or inserted into all receptacles 3 which are situated on carrier unit 2. The number of receptacles 3 connected to carrier unit 2 and inserted into a contact element depends on the capacity of the rechargeable battery to be connected or on the maximum level of the current which is to flow between connecting device 1 and the contact element. The more receptacles 3 positioned on carrier unit 2, the higher may be the current which flows between connecting device 1 and the contact element, and the greater may be the capacity of the rechargeable battery. A large number of receptacles 3 provides a larger connecting surface for the contact element, so that a high current may flow safely and without possible damage to connecting device 1.

It should be noted that it is also possible to vary the length of carrier unit 2 according to the number of receptacles 3. A shorter carrier unit 2 (in particular, a shorter base body) may thus be used when fewer than five receptacles 3 are positioned on carrier unit 2. Likewise, it is also possible to lengthen carrier unit 2 (or base body 4 of carrier unit 2) if more than five receptacles 3 are to be positioned on carrier unit 2.

Figure 24:
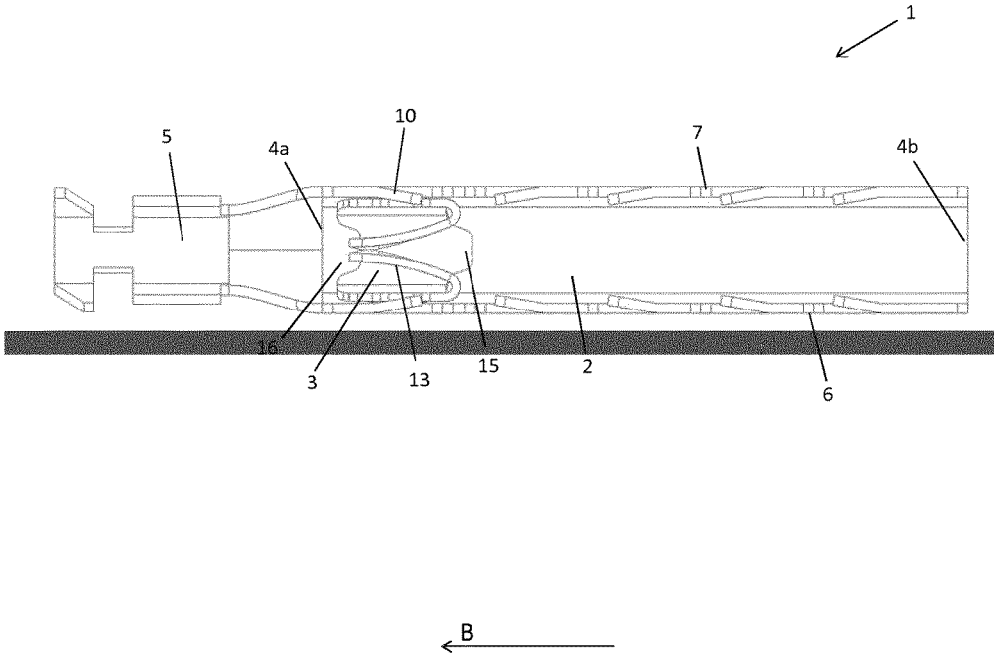
FIG. 24 shows a top view of the carrier unit according to the first specific embodiment, including one receptacle according to the first specific embodiment.
Figure 27:
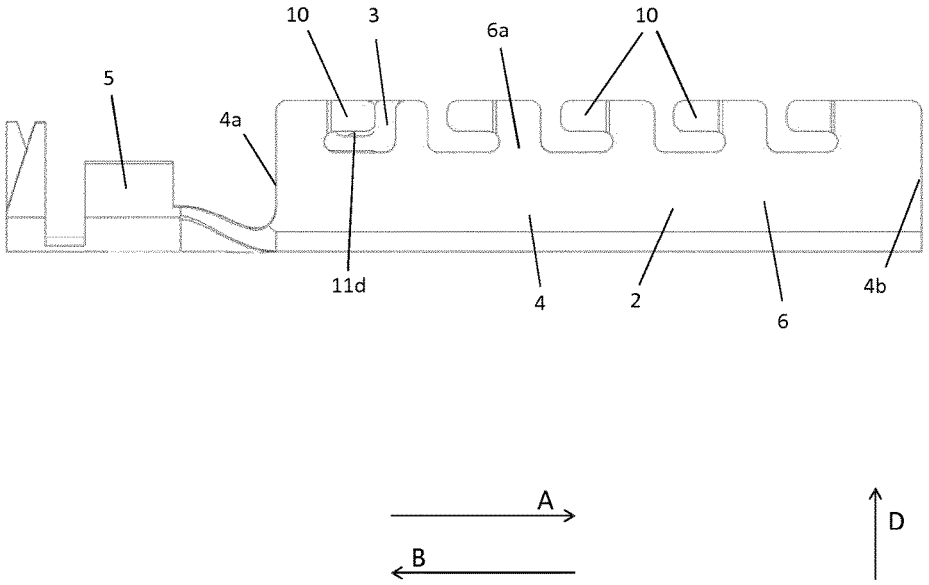
FIG. 27 shows a side view of the carrier unit according to the first specific embodiment, including one receptacle according to the first specific embodiment.
Figure 28:
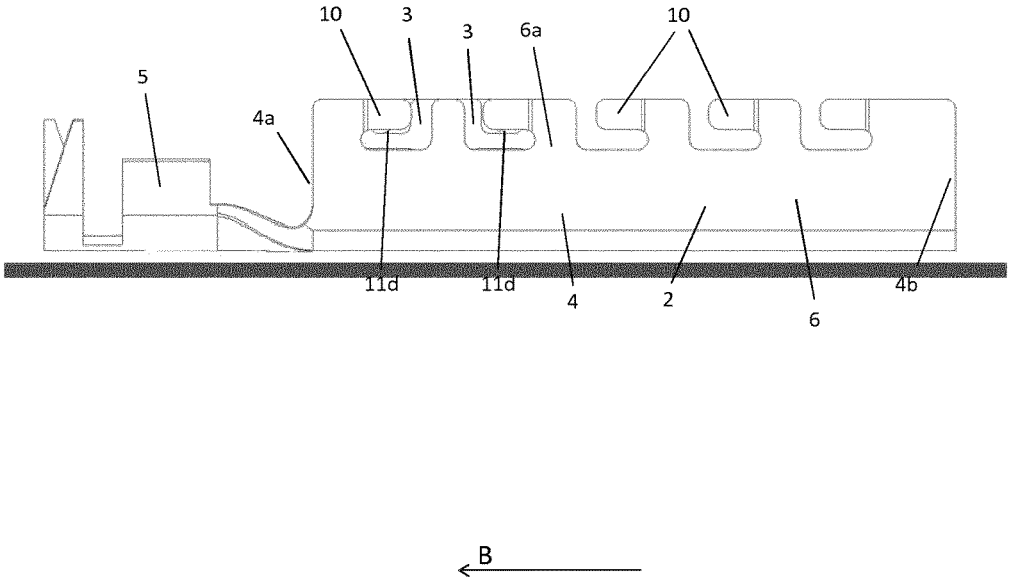
FIG. 28 shows a side view of the carrier unit according to the first specific embodiment, including two receptacles according to the first specific embodiment.
Figure 29:
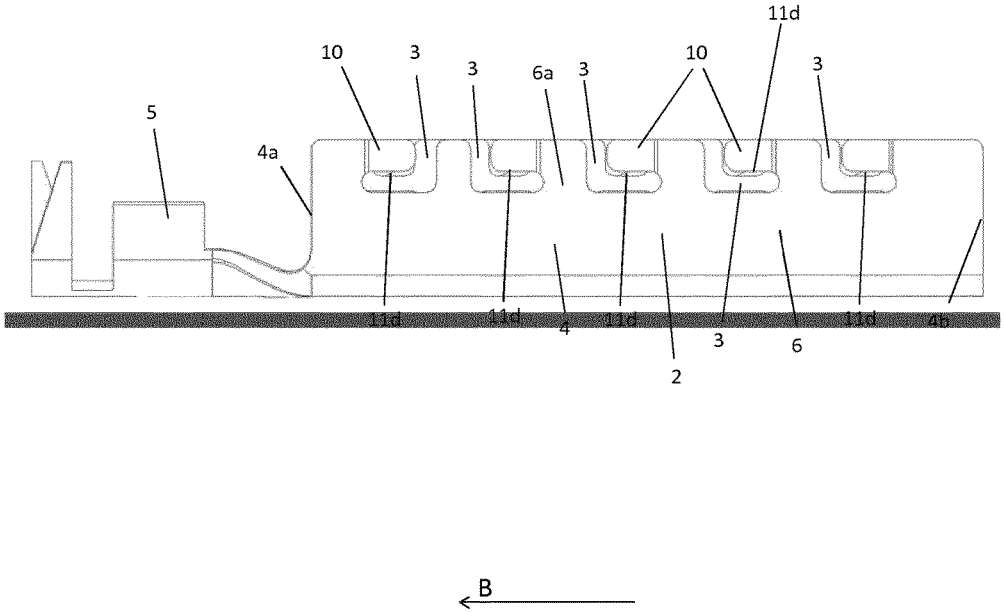
FIG. 29 shows a side view of the carrier unit according to the first specific embodiment, including five receptacles according to the first specific embodiment.
Figure 30:
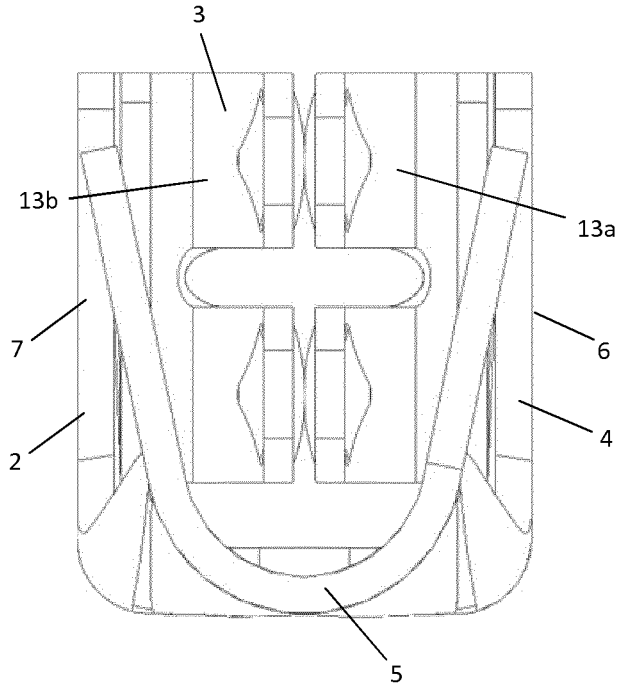
FIG. 30 shows a rear view of the carrier unit according to the first specific embodiment, including one receptacle according to the first specific embodiment.
Figure 31:
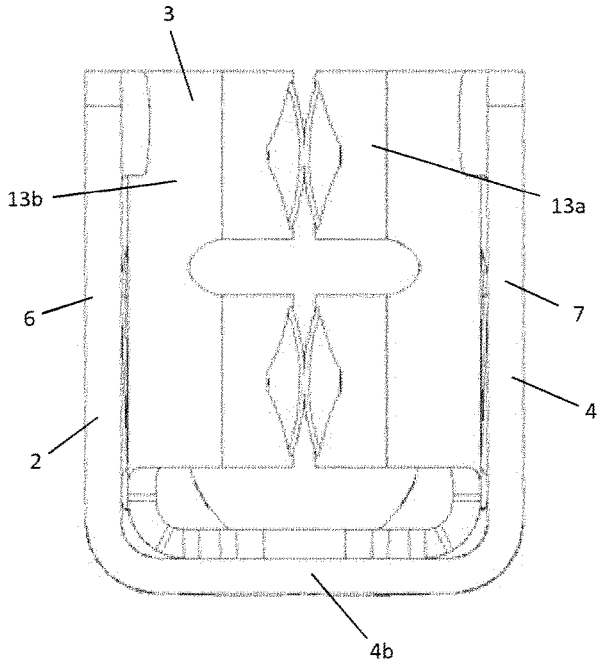
FIG. 31 shows a front view of the carrier unit according to the first specific embodiment, including one receptacle according to the first specific embodiment.
Figure 32:
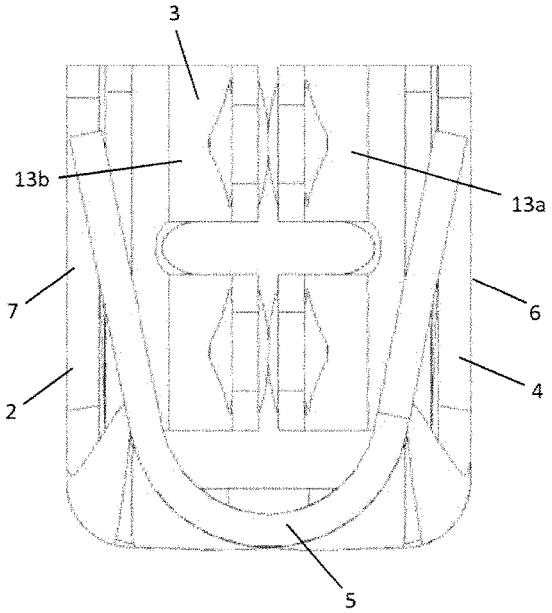
FIG. 32 shows a rear view of the carrier unit according to the first specific embodiment, including five receptacles according to a first specific embodiment.
Figure 33:
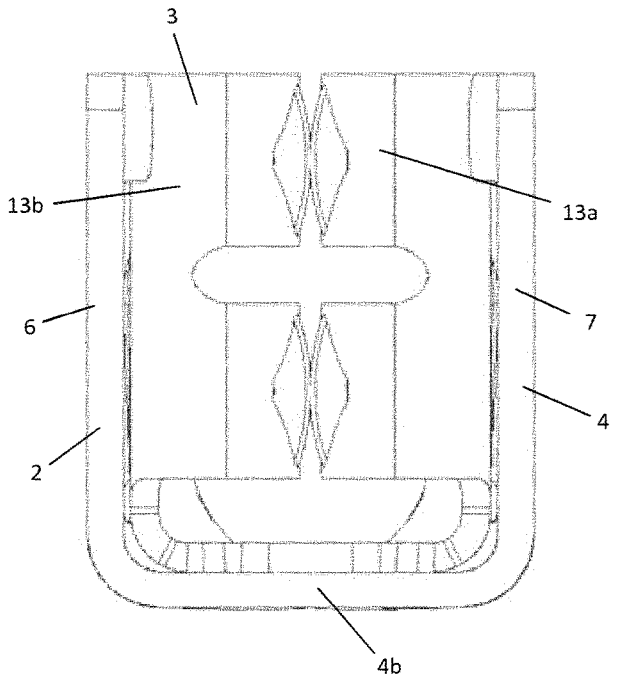
FIG. 33 shows a front view of the carrier unit according to the first specific embodiment, including five receptacles according to a first specific embodiment.

FIG. 24 shows a connecting device 1 according to the first specific embodiment, including a carrier unit 2, in which holding elements 10 are bent or offset. A receptacle 3 according to the first specific embodiment is positioned in base body 4 of carrier unit 2. Receptacle 3 is situated in the vicinity of first end 4*a* of base body 4. Receptacle 3 is positioned in base body 4 of carrier unit 2 in such a way that holding elements 10 of base body 4 of carrier unit 2 engage with particular recesses 11*d*, 12*d* of wall elements 11, 12 of receptacle 3. Particular holding element 10 protrudes over receptacle 3 (cf. FIG. 24) and toward receptacle 3 (cf. FIG. 27). As a result, receptacle 3 is positioned and held in carrier unit 2 in such a way that receptacle 3 is not able to fall out of carrier unit 2 (cf. FIGS. 24 and 27) against the holding force of holding element 10 in either direction A or direction D. Holding element 10 and recess 11*d*, 12*d* of receptacle 3 thus form a form-locked connection. Due to this form-locked connection, receptacles 3 do not need to be integrally connected to base body 4 of carrier unit 2. Due to the non-existent integral connection, receptacles 3 are able to be removed from carrier unit 2. This is advantageous, in particular, if one or multiple receptacle(s) 3 are to be removed from carrier unit 2 and/or replaced during the manufacturing process of connecting device 1. A damaged receptacle 3 may be replaced without having to dispose of complete connecting device 1, i.e. carrier unit 2 including already positioned receptacles 3. This saves time during the manufacturing process and reduces possible rejects.

FIG. 25 shows a connecting device 1 according to the first specific embodiment, including a carrier unit 2, in which holding elements 10 are bent or offset. Two receptacles 3 according to the first specific embodiment are positioned in base body 4 of carrier unit 2, and connect to two contact elements 202, 204 of a rechargeable battery 200 for example. The two receptacles 3 are positioned consecutively in series with respect to each other in direction B. The two receptacles 3 are positioned in base body 4 of carrier unit 2 in such a way that holding elements 10 of base body 4 of carrier unit 2 engage with particular recesses 11*d*, 12*d* of wall elements 11, 12 of receptacles 3. This means that convexity 15 of a first receptacle 3 is situated at indentation 16 of a second receptacle 3. Receptacles 3 are positioned and held hereby in carrier unit 2 (cf. FIG. 25).

Figure 26:
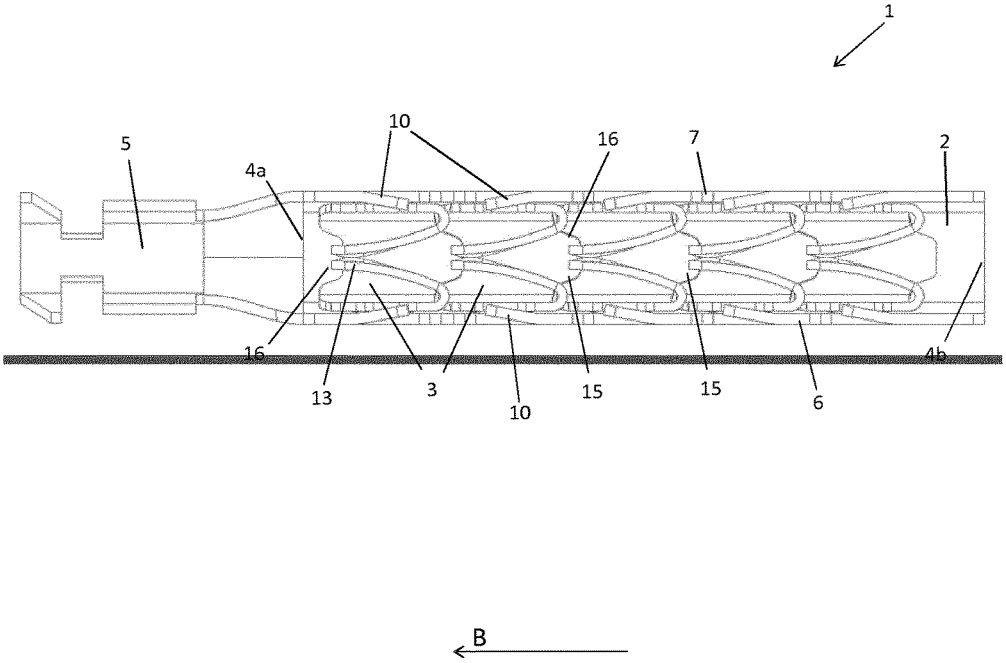
FIG. 26 shows a top view of the carrier unit according to the first specific embodiment, including five receptacles according to the first specific embodiment.

FIG. 26 shows a connecting device 1 according to the first specific embodiment, including a carrier unit 2, in which holding elements 10 are bent or offset. Five receptacles 3 according to the first specific embodiment are positioned in base body 4 of carrier unit 2. Five receptacles 3 are positioned consecutively in series with respect to each other in direction B. Five receptacles 3 are positioned in base body 4 of carrier unit 2 in such a way that holding elements 10 of base body 4 of carrier unit 2 engage with particular recesses 11*d*, 12*d* of wall elements 11, 12 of receptacles 3. This means that convexities 15 of receptacles 3 are situated at indentations 16 of adjacent receptacles 3. Receptacles 3 are positioned and held hereby in carrier unit 2 (cf. FIG. 26).

Figure 34:
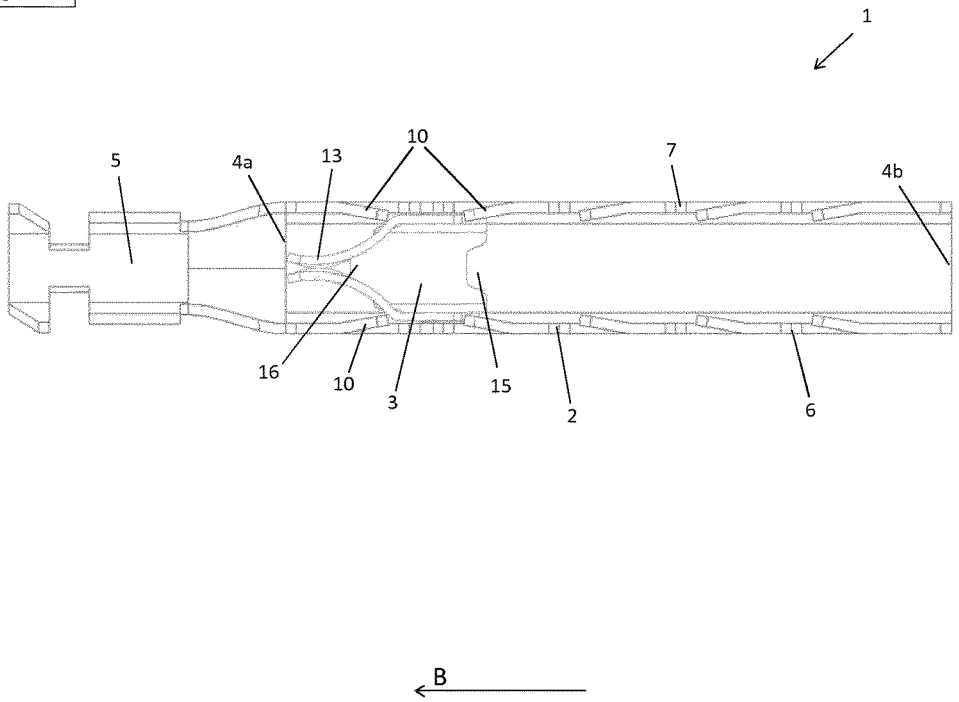
FIG. 34 shows a top view of the carrier unit according to the first specific embodiment, including one receptacle according to the second specific embodiment.

FIG. 34 shows a connecting device 1 according to the first specific embodiment, including a carrier unit 2, in which holding elements 10 are bent or offset. A receptacle 3 according to the second specific embodiment is positioned in base body 4 of carrier unit 2. Receptacle 3 is situated in the vicinity of first end 4*a* of base body 4. Receptacle 3 is positioned in base body 4 of carrier unit 2 in such a way that holding elements 10 of base body 4 of carrier unit 2 engage with particular recesses 11*d*, 12*d* of wall elements 11, 12 of receptacle 3. Receptacle 3 is positioned and held hereby in carrier unit 2 (cf. FIG. 34).

Figure 38:
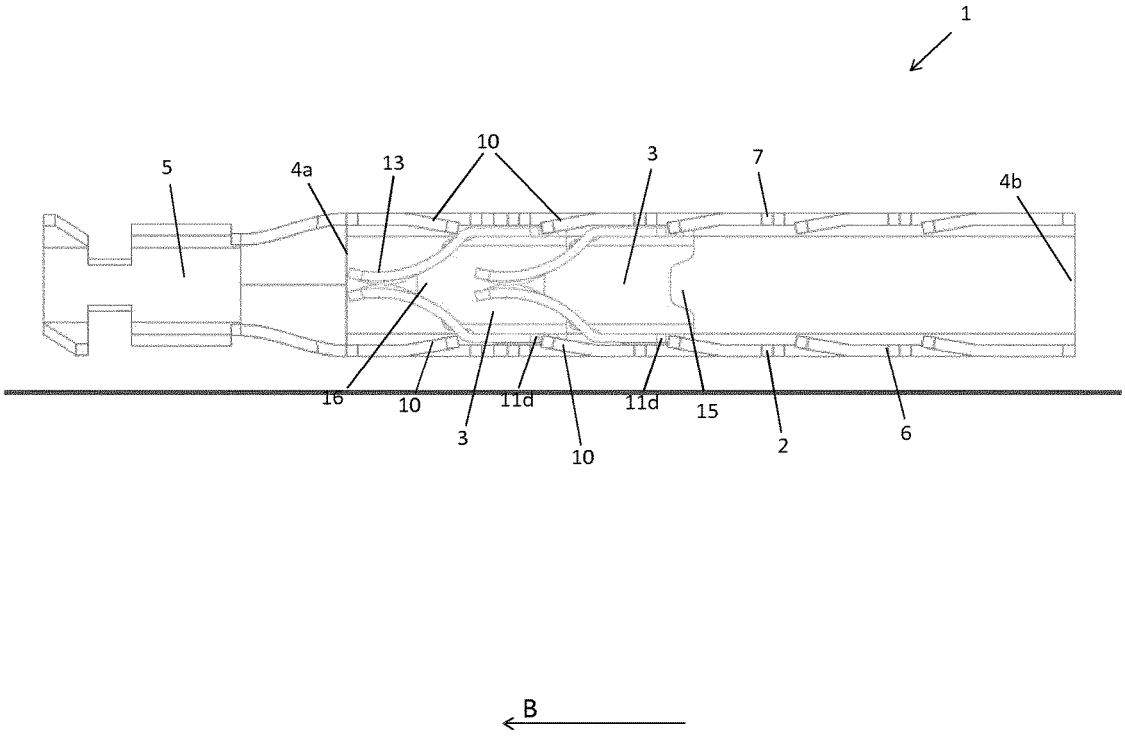
FIG. 38 shows a top view of the carrier unit according to the first specific embodiment, including two receptacles according to a second specific embodiment.

FIG. 38 shows a connecting device 1 according to the first specific embodiment, including a carrier unit 2, in which holding elements 10 are bent or offset. Two receptacles 3 according to the second specific embodiment are positioned in base body 4 of carrier unit 2. The two receptacles 3 are positioned consecutively in series with respect to each other in direction B. The two receptacles 3 are positioned in base body 4 of carrier unit 2 in such a way that holding elements 10 of base body 4 of carrier unit 2 engage with particular recesses 11*d*, 12*d* of wall elements 11, 12 of receptacles 3. This means that convexity 15 of a first receptacle 3 is situated at indentation 16 of a second receptacle 3. Receptacles 3 are positioned and held hereby in carrier unit 2 (cf. FIG. 38).

Figure 39:
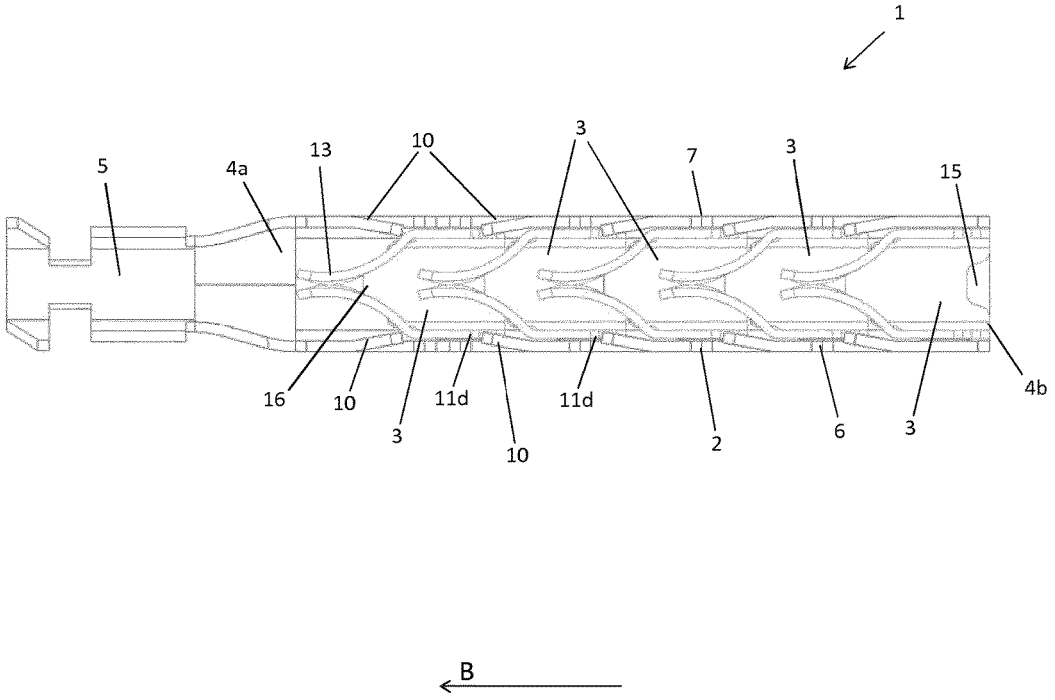
FIG. 39 shows a top view of the carrier unit according to the first specific embodiment, including five receptacles according to the second specific embodiment.

FIG. 39 shows a connecting device 1 according to the first specific embodiment, including a carrier unit 2, in which holding elements 10 are bent or offset. Five receptacles 3 according to the second specific embodiment are positioned in base body 4 of carrier unit 2. Five receptacles 3 are positioned consecutively in series with respect to each other in direction B. Five receptacles 3 are positioned in base body 4 of carrier unit 2 in such a way that holding elements 10 of base body 4 of carrier unit 2 engage with particular recesses 11*d*, 12*d* of wall elements 11, 12 of receptacles 3. This means that convexities 15 of first receptacles 3 are situated at indentations 16 of adjacent receptacles 3. Receptacles 3 are positioned and held hereby in carrier unit 2 (cf. FIG. 39).

Figure 35:
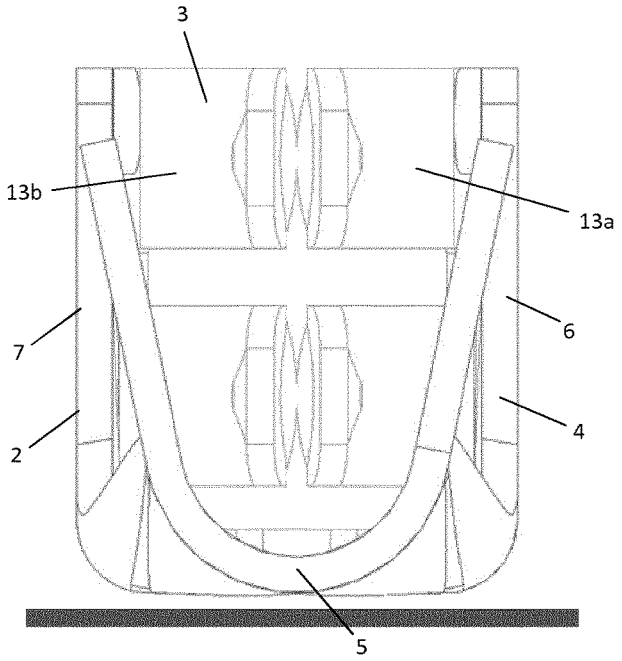
FIG. 35 shows a rear view of the carrier unit according to the first specific embodiment, including one receptacle according to the second specific embodiment.
Figure 36:
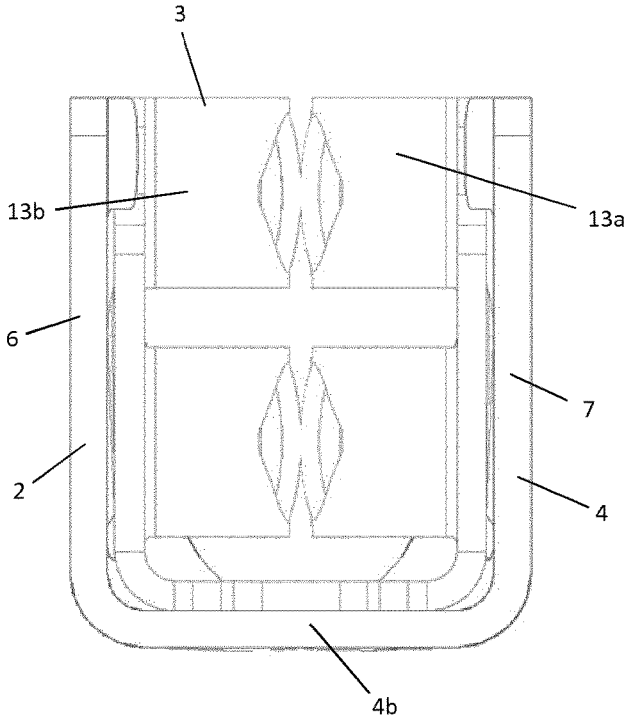
FIG. 36 shows a front view of the carrier unit according to the first specific embodiment, including one receptacle according to a second specific embodiment.
Figure 37:
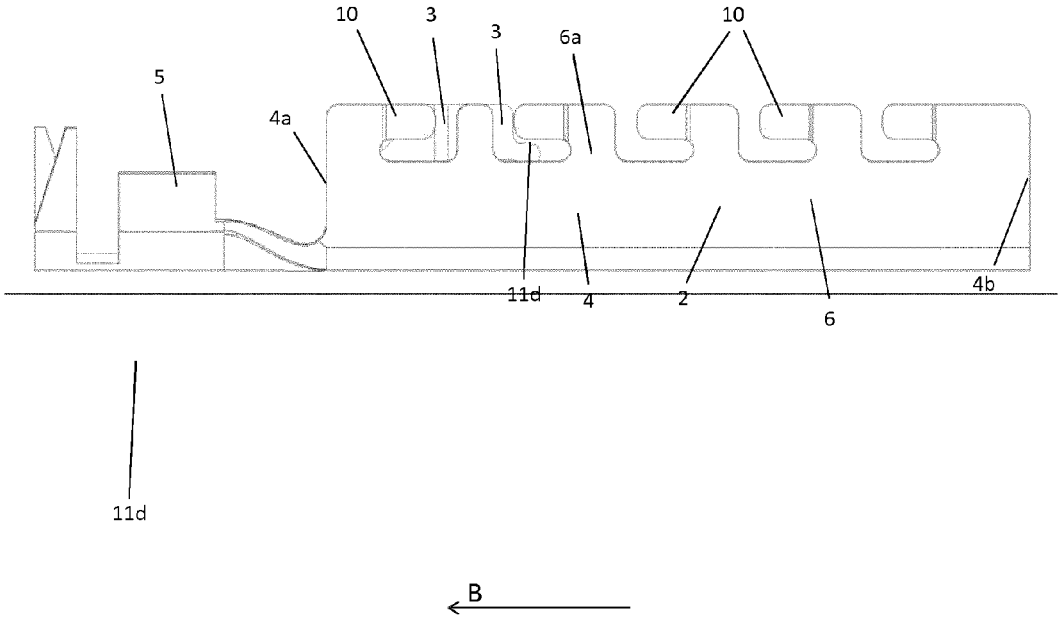
FIG. 37 shows a side view of the carrier unit according to the first specific embodiment, including one receptacle according to a second specific embodiment.
Figure 40:
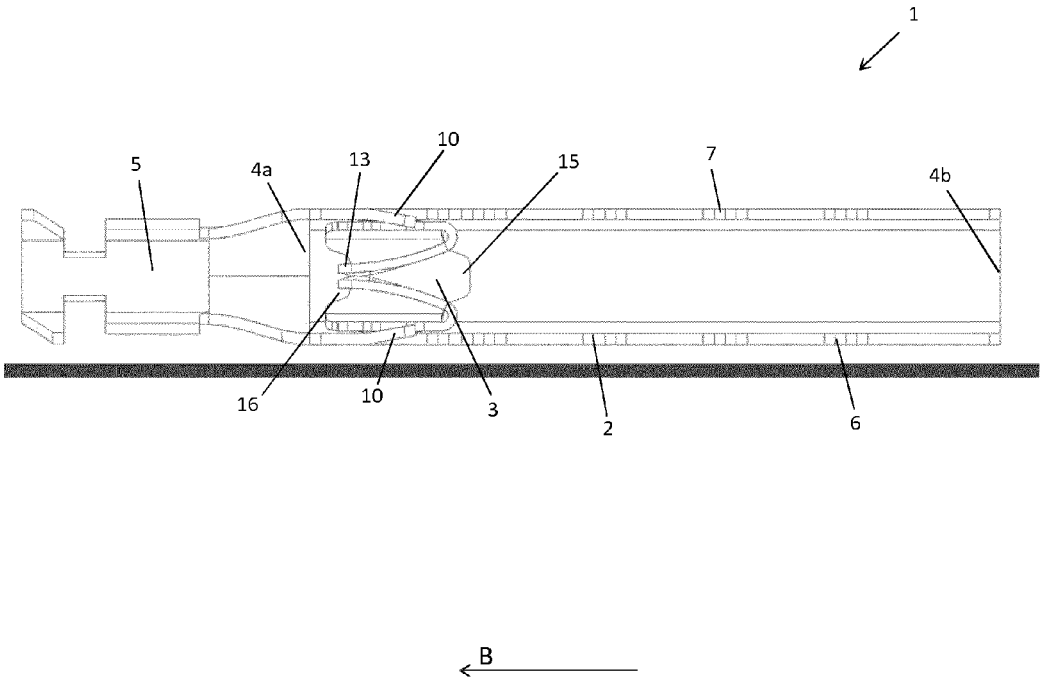
FIG. 40 shows a top view of the carrier unit according to the second specific embodiment, including one receptacle according to the first specific embodiment.
Figure 41:
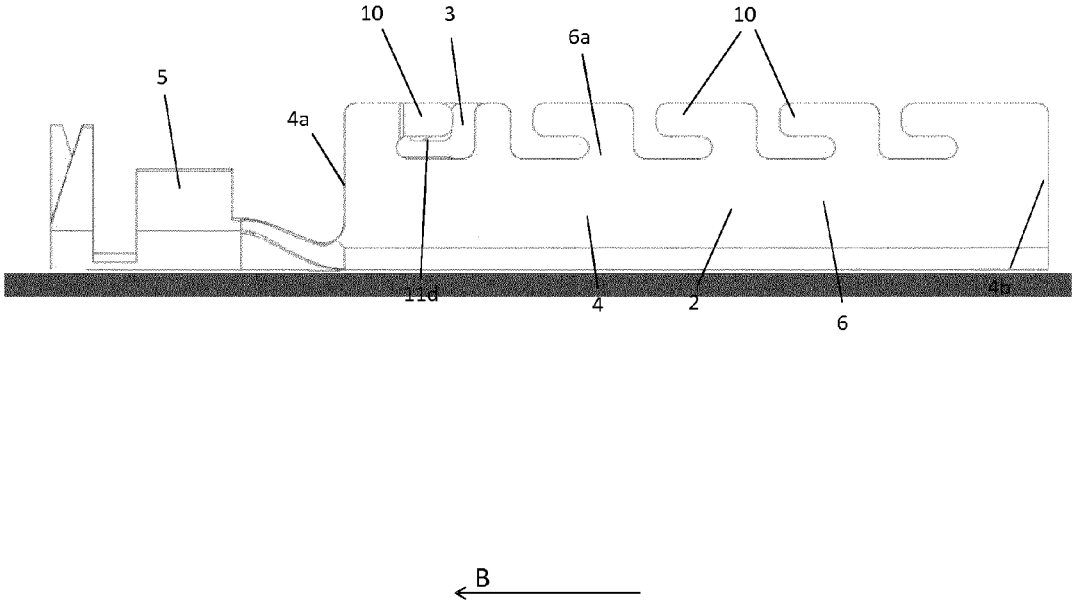
FIG. 41 shows a side view of the carrier unit according to the second specific embodiment, including one receptacle according to the first specific embodiment.

FIG. 40 shows a connecting device 1 according to the second specific embodiment, including a carrier unit 2, in which holding elements 10 are straight. A receptacle 3 according to the first specific embodiment is positioned in base body 4 of carrier unit 2. Receptacle 3 is situated in the vicinity of first end 4*a* of base body 4. Receptacle 3 is positioned in base body 4 of carrier unit 2 in such a way that holding elements 10 of base body 4 of carrier unit 2 engage with particular recesses 11*d*, 12*d* of wall elements 11, 12 of receptacle 3. Receptacle 3 is positioned and held hereby in carrier unit 2 (cf. FIGS. 35 and 36).

Figure 42:
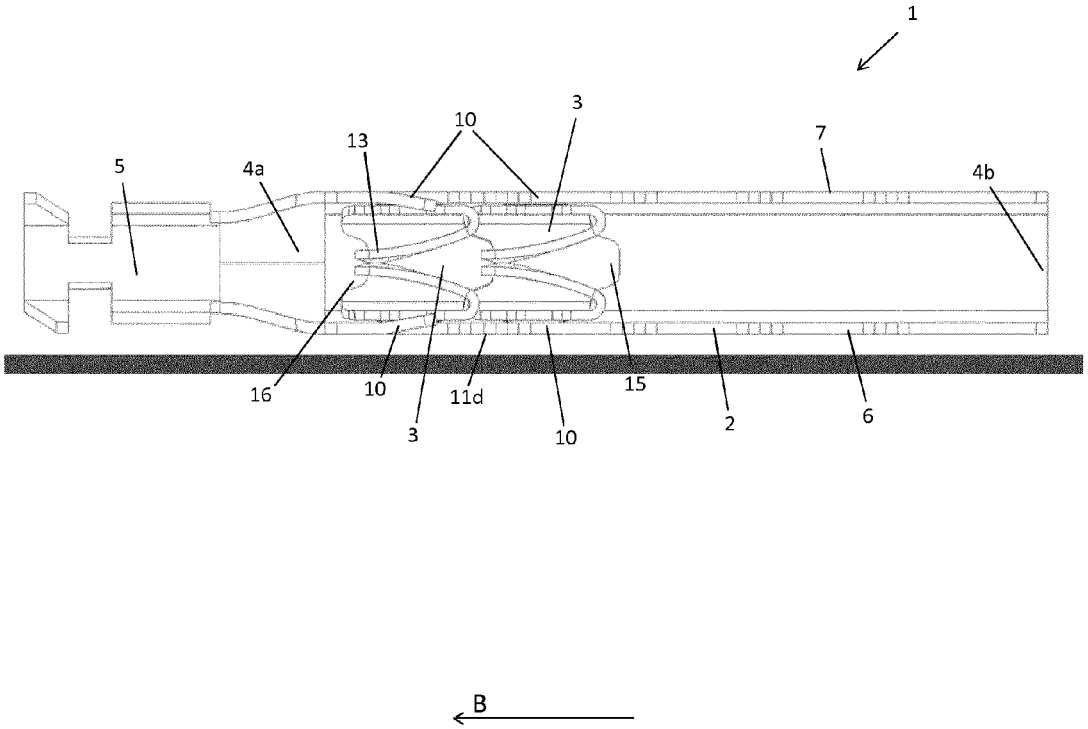
FIG. 42 shows a top view of the carrier unit according to the second specific embodiment, including two receptacles according to the first specific embodiment.

FIG. 42 shows a connecting device 1 according to the second specific embodiment, including a carrier unit 2, in which holding elements 10 are straight. Two receptacles 3 according to the first specific embodiment are positioned in base body 4 of carrier unit 2. The two receptacles 3 are positioned consecutively in series with respect to each other in direction B. The two receptacles 3 are positioned in base body 4 of carrier unit 2 in such a way that holding elements 10 of base body 4 of carrier unit 2 engage with particular recesses 11*d*, 12*d* of wall elements 11, 12 of receptacles 3. This means that convexity 15 of a first receptacle 3 is situated at indentation 16 of a second receptacle 3. Receptacles 3 are positioned and held hereby in carrier unit 2 (cf. FIG. 42).

Figure 43:
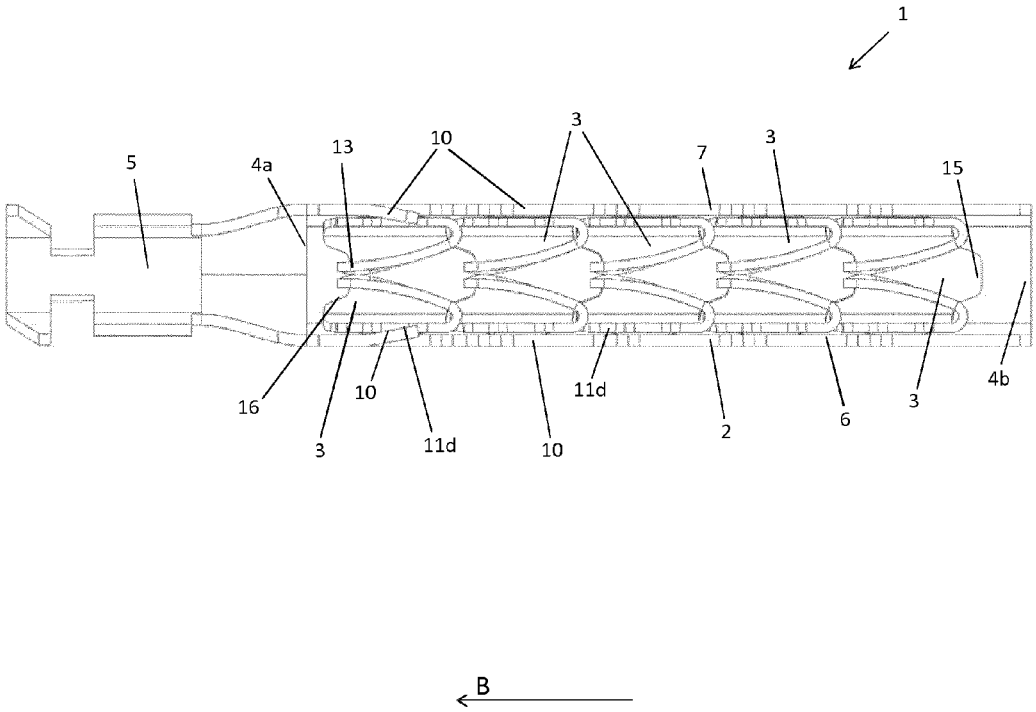
FIG. 43 shows a top view of the carrier unit according to the second specific embodiment, including five receptacles according to the first specific embodiment.
Figure 44:
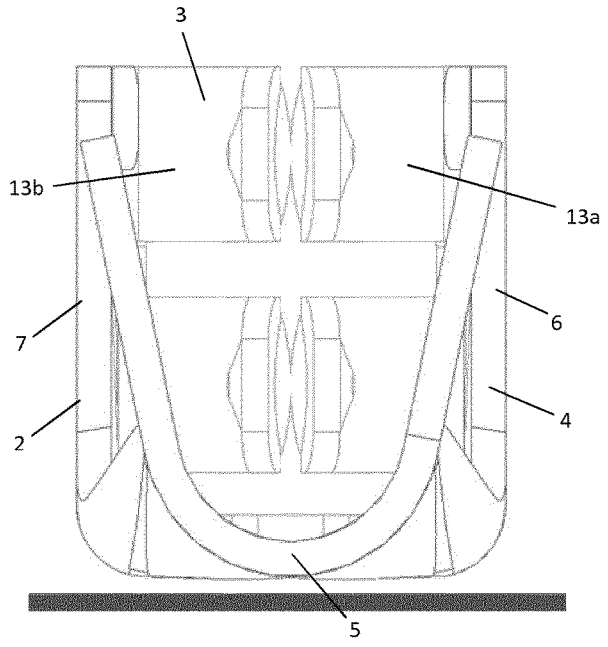
FIG. 44 shows a rear view of the carrier unit according to the second specific embodiment, including one receptacle according to the first specific embodiment.
Figure 45:
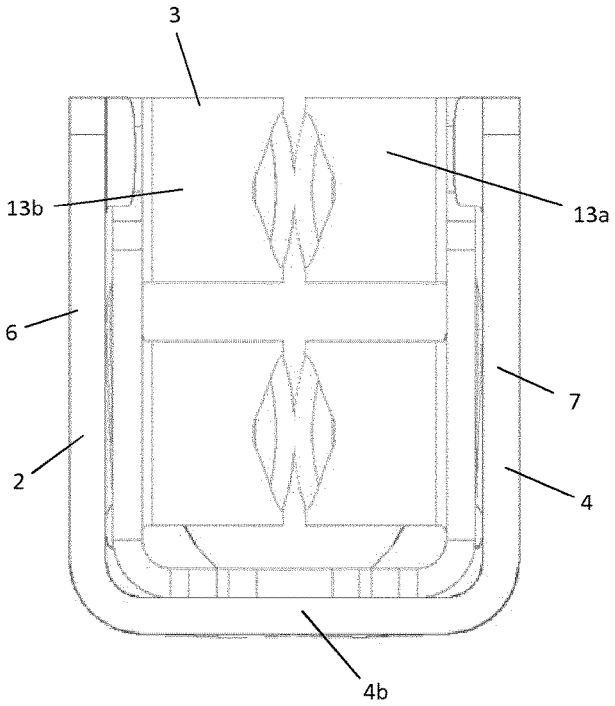
FIG. 45 shows a front view of the carrier unit according to the second specific embodiment, including one receptacle according to the first specific embodiment.

FIG. 43 shows a connecting device 1 according to the second specific embodiment, including a carrier unit 2, in which holding elements 10 are straight. Five receptacles 3 according to the first specific embodiment are positioned in base body 4 of carrier unit 2. Five receptacles 3 are positioned consecutively in series with respect to each other in direction B. Five receptacles 3 are positioned in base body 4 of carrier unit 2 in such a way that holding elements 10 of base body 4 of carrier unit 2 engage with particular recesses 11*d*, 12*d* of wall elements 11, 12 of receptacles 3. This means that convexities 15 of first receptacles 3 are situated at indentations 16 of adjacent receptacles 3. Receptacles 3 are positioned and held hereby in carrier unit 2 (cf. FIG. 43).

Figure 46:
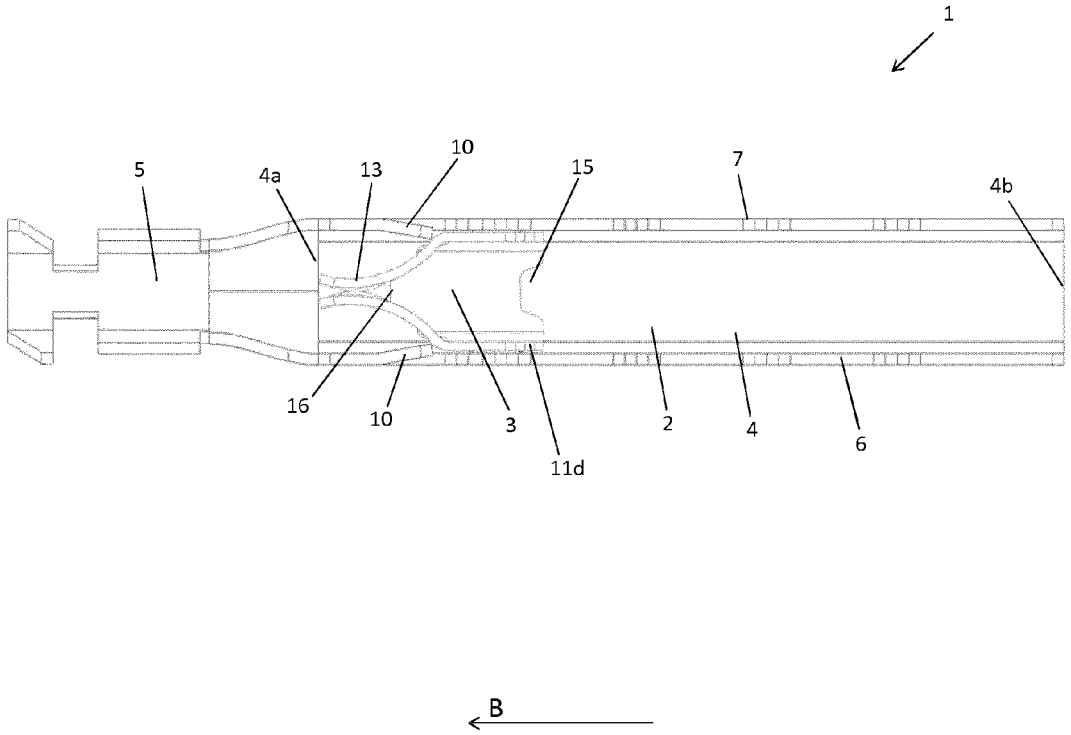
FIG. 46 shows a top view of the carrier unit according to the second specific embodiment, including one receptacle according to the second specific embodiment.
Figure 47:
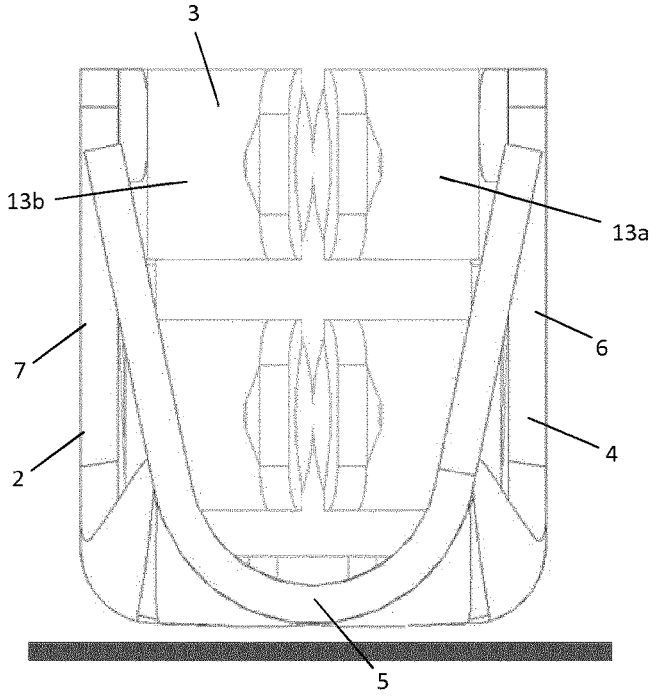
FIG. 47 shows a rear view of the carrier unit according to the second specific embodiment, including one receptacle according to the second specific embodiment.
Figure 48:
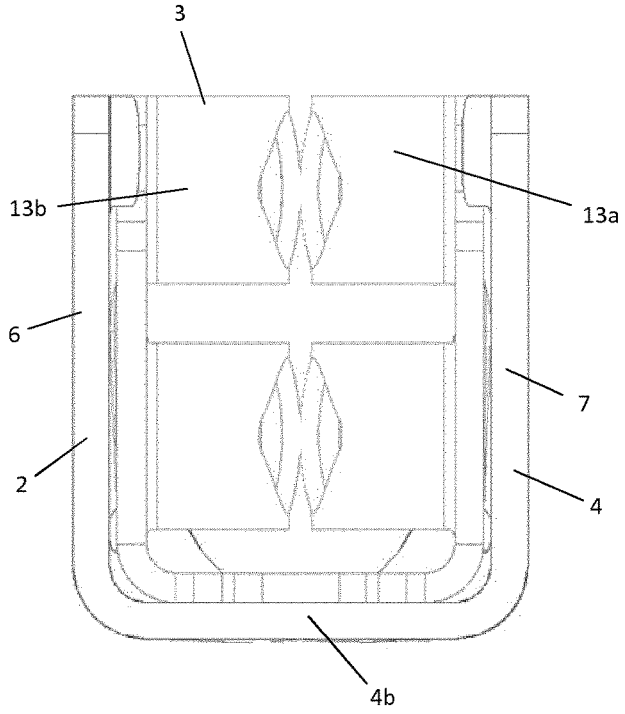
FIG. 48 shows a front view of the carrier unit according to the second specific embodiment, including one receptacle according to a second specific embodiment.

FIG. 46 shows a connecting device 1 according to the second specific embodiment, including a carrier unit 2, in which holding elements 10 are straight. A receptacle 3 according to the second specific embodiment is positioned in base body 4 of carrier unit 2. Receptacle 3 is situated in the vicinity of first end 4*a* of base body 4. Receptacle 3 is positioned in base body 4 of carrier unit 2 in such a way that holding elements 10 of base body 4 of carrier unit 2 engage with particular recesses 11*d*, 12*d* of wall elements 11, 12 of receptacle 3. Receptacle 3 is positioned and held hereby in carrier unit 2 (cf. FIG. 46).

Figure 49:
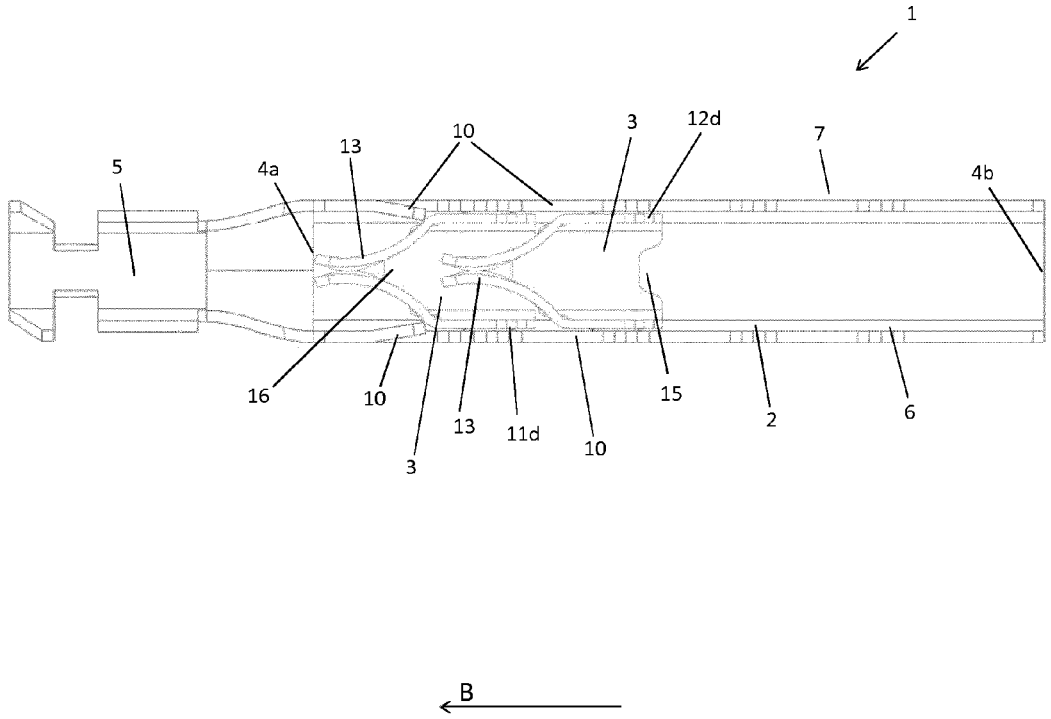
FIG. 49 shows a top view of the carrier unit according to the second specific embodiment, including two receptacles according to a second specific embodiment.

FIG. 49 shows a connecting device 1 according to the second specific embodiment, including a carrier unit 2, in which holding elements 10 are straight. Two receptacles 3 according to the second specific embodiment are positioned in base body 4 of carrier unit 2. The two receptacles 3 are positioned consecutively in series with respect to each other in direction B. The two receptacles 3 are positioned in base body 4 of carrier unit 2 in such a way that holding elements 10 of base body 4 of carrier unit 2 engage with particular recesses 11*d*, 12*d* of wall elements 11, 12 of receptacles 3. This means that convexity 15 of a first receptacle 3 is situated at indentation 16 of a second receptacle 3. Receptacles 3 are positioned and held hereby in carrier unit 2 (cf. FIG. 49).

Figure 50:
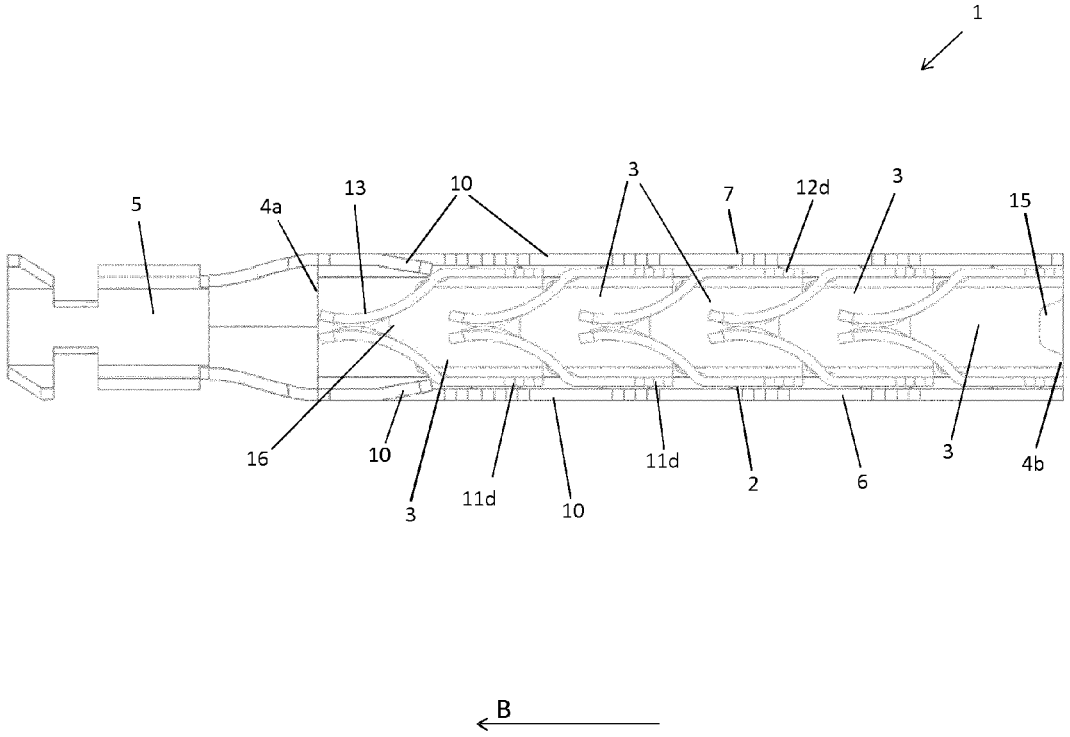
FIG. 50 shows a top view of the carrier unit according to the second specific embodiment, including five receptacles according to a second specific embodiment.

FIG. 50 shows a connecting device 1 according to the second specific embodiment, including a carrier unit 2, in which holding elements 10 are straight. Five receptacles 3 according to the second specific embodiment are positioned in base body 4 of carrier unit 2. Five receptacles 3 are positioned consecutively in series with respect to each other in direction B. Five receptacles 3 are positioned in base body 4 of carrier unit 2 in such a way that holding elements 10 of base body 4 of carrier unit 2 engage with particular recesses 11*d*, 12*d* of wall elements 11, 12 of receptacles 3. This means that convexities 15 of first receptacles 3 are situated at indentations 16 of adjacent receptacles 3. Receptacles 3 are positioned and held hereby in carrier unit 2 (cf. FIG. 50).

Receptacles 3 according to the first specific embodiment are connected to carrier unit 2 according to the first specific embodiment in a force-locked or form-locked manner. In other words, receptacles 3 are clamped between particular holding elements 10 and held in position thereby. The connection between receptacles 3 and carrier unit 2 according to the first specific embodiment is thus detachable.

In comparison thereto, receptacles 3 according to the second specific embodiment are integrally connected to carrier unit 2 according to the second specific embodiment. Integral connections include, for example, welding, soldering, gluing or the like.

A connecting device 1 is consequently to be provided for detachably connecting electrical connections, for example between a rechargeable battery and an electrical power tool or a rechargeable battery and a charging device, with the aid of which, in particular, an improved, i.e. modularly usable, connecting device 1 may be made available, which is more flexible to manufacture.

The invention claimed is:

1. A connecting device for detachably connecting electrical connections, the connecting device comprising: a carrier unit; and at least one first receptacle connectable to the carrier unit; at least one second receptacle connectable to the carrier unit, the at least first and second receptacles being positioned consecutively in series along the carrier unit in such a way that a contact element is connected to the at least first and second receptacles when the contact element is connected to the connecting device; wherein each of the first and second receptacles includes a first end, a second end, a base element, a first wall element, a second wall element and a spring unit, including a first spring element and a second spring element, for accommodating and holding a contact element, the first spring element being connected to the first wall element, and the second spring element being connected to the second wall element; wherein the carrier unit includes a U profile having at least two holding elements for positioning and holding the first receptacle on the carrier unit.

2. The connecting device as recited in claim 1 wherein the first spring element and the second spring element extend from the first end of the receptacle between the first and second wall elements to the second end of the receptacle in a first direction.

3. The connecting device as recited in claim 1 wherein the first spring element and the second spring element extend from the second end of the receptacle in a first direction.

4. A rechargeable battery connecting device for detachably connecting a rechargeable battery and an electrical power tool or the rechargeable battery and a charging device, the rechargeable battery connecting device comprising the connecting device as recited in claim 1.

5. A connecting device for detachably connecting electrical connections, the connecting device comprising: a carrier unit; and at least one first receptacle connectable to the carrier unit; at least one second receptacle connectable to the carrier unit, the at least first and second receptacles being positioned consecutively in series along the carrier unit in such a way that a contact element is connected to the at least first and second receptacles when the contact element is connected to the connecting device; wherein each of the first and second receptacles includes a first end, a second end, a base element, a first wall element, a second wall element and a spring unit, including a first spring element and a second spring element, for accommodating and holding a contact element, the first spring element being connected to the first wall element, and the second spring element being connected to the second wall element; wherein the base element of the first receptacle includes a convexity and an indentation, the convexity being situated opposite the indentation, and a design of the convexity corresponding to an indentation design of the indentation so that the convexity of the first receptacle is insertable into the indentation of a second receptacle.

6. A connecting device for detachably connecting electrical connections, the connecting device comprising: a carrier unit; and at least one first receptacle connectable to the carrier unit; at least one second receptacle connectable to the carrier unit, the at least first and second receptacles being positioned consecutively in series along the carrier unit in such a way that a contact element is connected to the at least first and second receptacles when the contact element is connected to the connecting device; wherein each of the first and second receptacles includes a first end, a second end, a base element, a first wall element, a second wall element and a spring unit, including a first spring element and a second spring element, for accommodating and holding a contact element, the first spring element being connected to the first wall element, and the second spring element being connected to the second wall element; wherein the carrier unit has a first side element and a second side element defining an elongated cavity to accommodate the at least one first receptacle and the at least one second receptacle, the first and second side elements having holding elements for positioning and holding the at least one first receptacle and the at least one second receptacle.

7. The connecting device as recited in claim 6 wherein the holding elements extend straight with respect to the first and second side elements.

8. The connecting device as recited in claim 6 wherein at least some of the holding elements are opposite to each other and toward each other.

9. The connecting device as recited in claim 6 wherein the at least one first receptacle and the at least one second receptacle each have a first elevation positioned on the first wall element and a second elevation positioned on the second wall element, the first and second elevations contacting the carrier unit.

* * * * *